US006039677A

United States Patent [19]

Spletzer

[11] Patent Number: 6,039,677

[45] Date of Patent: Mar. 21, 2000

[54] EXERCISE THIGH WEIGHT SYSTEM

[76] Inventor: David Spletzer, 203 Bay 23rd St., Brooklyn, N.Y. 11214

[21] Appl. No.: 09/211,019

[22] Filed: Dec. 14, 1998

Related U.S. Application Data

[63] Continuation-in-part of application No. 08/847,872, Apr. 28, 1997, Pat. No. 5,868,652, which is a continuation-in-part of application No. 08/676,941, May 6, 1996, abandoned.

[51] Int. Cl.[7] ..... A63B 23/04

[52] U.S. Cl. ..... 482/105; 224/222; 2/22

[58] Field of Search ..... 482/1, 105, 106, 482/93, 124; 224/222, 677, 904, 661, 681, 682; 2/22, 319, 912, 238, 227, 79

[56] References Cited

U.S. PATENT DOCUMENTS

| | | | |
|---|---|---|---|
| 3,751,031 | 8/1973 | Yamauchi | 482/105 |
| 4,180,261 | 12/1979 | Kolka | 2/22 X |
| 4,303,187 | 12/1981 | Berman | 224/222 |
| 4,303,239 | 12/1981 | Walsh | 272/119 |
| 4,356,943 | 11/1982 | Berman | 224/222 |
| 4,852,782 | 8/1989 | Wu | 224/222 X |
| 5,010,596 | 4/1991 | Brown | 482/105 X |
| 5,075,902 | 12/1991 | McReynolds | 2/238 |
| 5,102,123 | 4/1992 | Roark | 482/103 |
| 5,106,082 | 4/1992 | Moschetti | 482/105 X |
| 5,129,647 | 7/1992 | Castellanos | 482/124 |
| 5,868,652 | 2/1999 | Speltzer | 482/105 |

*Primary Examiner*—Richard J. Apley
*Assistant Examiner*—Denise Pothier
*Attorney, Agent, or Firm*—Richard B. Klar

[57] ABSTRACT

An exercise thigh weight system that includes a sturdy, semi-rigid, and adjustable waist belt, a right leg harness assembly, right leg harness assembly attaching apparatus, a left harness assembly, and left leg harness assembly attaching apparatus.

20 Claims, 7 Drawing Sheets

EXERCISE THIGH WEIGHT SYSTEM

CROSS REFERENCE TO RELATED APPLICATIONS

The present application is a continuation-in-part of U.S. patent application Ser. No. 08/847,872 filed on Apr. 28, 1997, now U.S. Pat. No. 5,868,652, for which the issue fee was paid on Oct. 6, 1998 and which in turn is a continuation-in-part of U.S. patent application Ser. No. 08/676,941 filed on May 6, 1996, now abandoned and claims priority therein pursuant to 37 C.F.R. 1.120.

The instant application contains subject matter disclosed in applicant's Disclosure Document No. 390818 filed on Jan. 29, 1996. And as such, it is respectfully requested that this Disclosure Documents be relied upon and remain a permanent part of the file history during the prosecution of the instant application and during any subsequent action thereof. The present application is a continuation-in-part of U.S. patent application Ser. No. 08/847,872 filed on Apr. 28, 1997 for which the issue fee was paid on Oct. 6, 1998 and which in turn is a continuation-in-part of U.S. patent application Ser. No. 08/676,941 filed on May 6, 1996 and claims priority therein pursuant to 37 C.F.R. 120.

BACKGROUND OF THE INVENTION

The present invention relates to an exercise thigh weight system. More particularly, the present invention relates to an exercise thigh weight system that completely encircles the leg, assuring symmetrical development; is supported by the lateral line of the body, in line with the femur, and gravity, therefore there is no forward pull, such as with weight vests and ankle weights, and thus no potential back problems; provides no impact/inertia on the knee ligaments since the weight is supported by the waist belt, eliminating any damaging "pull" that is possible with ankle weights; and has encircling/supported weights that are more ergonomic in design, unlike weights that are on front, or are contained in shorts which will move with inertia.

Thigh weights relate to new and useful improvements in exercise weights that are worn on the body. The prior art in the exercise field includes ankle weights, wrist weights, weighted belts, weighted vests, and even head weights. With the exception of the latter item, for which specific neck exercises are prescribed, all of the mentioned weights may be worn while performing common, conventional exercises, such as, inter alia, jogging, hiking, playing tennis, riding a bicycle, and so forth. Indeed, the idea behind exercising with weights worn on the body is to enable the wearer to participate in their favorite sport or activity in a relatively unhindered manner, with the extra resistance strengthening and toning their muscles simultaneously.

The thigh weights utilize this same principle, but they exercise different muscle groups in an unprecedented manner. They work the flexor muscle group of the upper thighs, or those muscles which bend the upper thighs. They also concurrently work the extensor muscle group of the thighs, or the muscles which straighten them. Additionally, this muscle group activity is performed in either leg independently, or while one leg works the flexors and the other leg works the extensors.

Such simultaneous muscle group work is accomplished when an individual is running or walking while wearing the thigh weights. With each stride or step the foot must leave the ground. As the foot comes up the leg must bend, at least in the conventional method of running or walking. It is this bending of the leg which causes the raising of the foot, and the bending caused by thigh flexor muscle activity.

Consequently, each stride or step, i.e. each raising of the foot, works the flexor muscles of the thigh. The overloading of these muscles by placing the thigh weights on them serves to give them additional work whenever that foot comes up off the ground.

Yet the flexor muscle group action is only half of the running or walking motion. As an individual is bringing his foot up off the ground by bending his leg, he is simultaneously straightening his other leg. In other words, while one leg is off the ground, and swinging through the air, the other leg is firmly planted on the ground, serving as a base or support from which the bending or swinging motion is launched. In running, by definition, both legs are off the ground simultaneously for a brief instant, yet the same principle holds for practical purposes. So as one leg bends or flexes, the other leg straightens or extends. It must be kept in mind that the thigh weights offer additional resistance to the extensor muscle group. While one leg is bending and overcoming the thigh weight resistance on it, the straightening leg must also overcome the extra resistance on it.

The thigh weights attach just below the waist of the user, and any extra weight attached in many other places on the body, will give additional work to the extensor muscle group. In fact, in an activity such as jumping off of both legs, where the extensor muscles are used simultaneously, there is little flexor activity since the feet do not leave the ground as the legs bend. The extra weight of the thigh weights will in its entirety be used to overload these extensor muscles. Quite simply, the body is jumping with extra pounds attached to it.

Of the prior art in the field, the closest item to the thigh weights are the ankle weights. Not only are some different muscle groups worked, as previously stated, however, but the same muscle groups are worked in a distinguishable manner.

To see the differences between thigh weights and ankle weights one may make his own brief test as follows. Using a heavy shoe or boot in lieu of ankle weights, or else having someone place pressure on your foot, or the ankle weights themselves may of course be used if available, attempt to straighten the knee while seated. A working of the muscles just above the knee is felt. Next, secure a pair of blue jeans or work pants with good front pockets, and place a small barbell plate or other similarly sized and weighted object in the front pockets. Then perform the same test of straightening the knee while seated. No extra stress above the knee is felt. Consequently, the ankle weights work those extensor muscles above the knee while the foot is moving or off the ground. The thigh weights do not work this muscle group in this manner.

As such, all that has been stated thus far is that the ankle weights work a particular muscle group that the thigh weights do not while performing a single exercise. Such can hardly be said to be evidence as to the beneficial uniqueness of the thigh weights when compared to the ankle weights. Therefore, a few more comparative tests to show the isolated differences in how the two devices work the muscles, and an analysis of the walking running motion to integrate such differences, are presented, infra.

When one raises the leg and bends the knee while wearing the simulated ankle weight object, muscle stress in the flexor muscle group of the upper thigh is experienced. Then with the leg raised, the knee is straightened. The extensor muscles above the knee are worked with some muscle tension remaining on the upper thigh flexor muscles to keep the leg raised. It can be seen that the ankle weights also work both the flexor and extensor muscles of the legs.

With this in mind, it is logical to question the differences between the two units, other than that which has thus far been stated as to muscles the ankle weights work and the thigh weights do not. Such shall now be presented forthwith.

The thigh weights work the flexor muscles much more than do the ankle weights. This is true because they are heavier than most ankle weights being used today.

Thigh weight units of varying capacities exist. One unit holds a maximum of six (6) pounds per leg, while another holds ten (10) pounds. In fact, an earlier rough thigh weight model held eighteen (18) pounds of weight over each thigh. Such model being worn while running on an experimental basis.

By contrast, the vast majority of ankle weights in use weigh two and one half (2½) or at the most three (3) pounds. While it is true that ankle weights are available in heavier models, such are awkward to run with and seldom used. In any event, the heaviest ankle weights possible are not as heavy as the heaviest thigh weights. Quite simply, there is a larger area around the thighs than around the ankles, and room for more weight resultingly.

The other reason that thigh weights work the flexor muscles more than the ankle weights do is because they do not work the muscles below the knee as do ankle weights. The reasoning behind this is that when the foot is raised off the ground the knee is bent. If the foot is moved in other than a strictly vertical position, as is almost always the case, the muscles above the knee must come into play. In other words, when the foot raises and swings freely, such as in the regular running motion, the extensor muscles above the knee are worked. When this muscle group is so activated, part of the load is assumed by it, and thus less of the load is assumed by the flexor muscle group.

In thigh weight movement, such a motion of the foot in an other than vertical direction does not affect those muscles over the knee because there is no weight on the foot. All the weight is directly over the flexor muscle group bringing only the flexor muscles during bending and swinging of the leg into play. There is simply no resistance elsewhere to bring other muscle groups into play and detract from flexor muscle group activity.

As stated earlier, the thigh weights work both the flexor and the extensor muscle groups, as do the ankle weights. In addition to working the flexor muscles more fully, the thigh weights work the extensor muscles more fully as well. They also work the flexor and extensor muscles in a unique combination, one different from the method in which the ankle weights do. The following paragraphs shall expound upon these statements.

Let us compare how the thigh weights work the extensor muscles more fully than do the ankle weights, and then integrate this superiority of extensor muscle activity into the unique manner in which thigh weights work both muscle groups when compared to the way in which ankle weights do.

First of all, thigh weights work the extensor muscles more severely because, as discussed earlier, they are by and large substantially heavier. It should be kept in mind that the extensor muscles of the legs are perhaps the strongest muscle group of the body and a resistance substantially in excess of that of the typical ankle weights may be used readily.

In addition to being heavier, thigh weights also work the extensor muscles more because of their location. To demonstrate this, another brief test is called for. Simulating ankle weight and thigh weight units as suggested earlier, the legs are merely bent and straightened. This movement is first performed in the heavy shoes or boots for the ankle weight simulation, and then with the objects in the pockets for the thigh weight simulation. For best results, the "thigh weights" should be at least twice as heavy as the "ankle weights" if at all possible, duplicating the weight ratio of the actual units. It is observed that the extensor muscles are worked when wearing the thigh weight simulated device. This is because they are above the knee and connected to the muscles which are actually moving, the thighs. Since the ankle weights attach below the knee, they are not fastened to or above any muscles which move when performing this simple exercise, ipso facto, the feet not moving while exercising.

There exists the possibility that one might not have been able to entertain an appreciable difference when performing the exercise procedures previously outlined. This is to say that the extensor muscle group may not have been felt to have been taxed more during the wearing of the thigh weight simulated unit than during the wearing of the ankle weight simulated unit. If this is the case, imagine doing the same exercise with the feet cast in concrete blocks in place of the ankle weights. Again, there is little or no extra resistance to the extensor muscle group, as no load is on or above them and the legs straighten against no opposing force. Then imagine performing the same exercise with the same concrete blocks placed directly over the thighs, attached from a belt and simulating, of course, the thigh weights. Here there is a severe resistance on the extensor muscles of the legs, and the weight of the blocks must be overcome for the legs to straighten.

On further discussion of how thigh weight work the extensor muscles more fully, a comparison of two well known weight training exercises will be beneficial. These exercises are the thigh extension and the squat.

The common extension exercise is done very similarly to the initial ankle weight test that was performed. The difference is that a special apparatus, consisting of a table with a swinging weighted bar attached to it, is used. The subject sits on the table with his knees bent and, places his feet under the weighted bar, and moves it up and out by straightening his legs. It is not difficult to see how this thigh extension exercise movement simulates a leg straightening with an ankle weight attached to it, which is of course, the extensor muscle activity that takes place with ankle weights on.

The squat exercise is merely the bending and straightening of the legs against a weighted resistance. The last exercise test performed, that of bending and straightening the legs with first "ankle weights" on and then "thigh weights" on, was actually a squat exercise. This exercise is usually done, however, by placing a heavily weighted barbell over the shoulders and then bending and straightening the legs. The muscle stress takes place, of course, during the straightening, or extending action.

It can be seen that the squat exercise simulates the extensor activity that takes place when extending the legs while wearing thigh weights. Indeed, when the user straightens the leg with the thigh weights on, he is simulating the straightening action that occurs when squatting, and vice versa. It is easy to recall the straightening of the legs with the concrete block "thigh weights" on, and to imagine the great stress they would place on the extensor muscles.

The only real difference between extending the legs under a barbell and extending them with thigh weights secured is that only one leg at a time extends while walking or running with the thigh weights. Squats, on the other hand, are generally done with both legs at once, working both groups of extensors concurrently.

It has thus far been shown that thigh extensions simulate ankle weight extensor activity, and squats simulate thigh weight extensor activity. With this in mind, consider that the vast majority of individuals are able to squat with far more weight than they can extend with their thighs. This can be found to be true by observing weight trainees over many years in various gymnasiums.

The conclusion that may then be reached is that squatting works not only different muscle fibers within the extensor muscle group, but, since substantially more weight is used, it works more muscle fibers than does thigh extending. It follows that thigh extension exercise, simulating squatting, works different muscle fibers and more muscle fibers than does ankle weight extension exercise, which simulates thigh extension. It is crystal clear that the thigh weights work the extensor muscles of the legs in a manner totally different from the way in which the ankle weights work the same general muscle group.

In comparing the thigh weights and ankle weights further, a very important point must be considered. The ankle weights work the extensors and flexors only when the foot is off the ground and the leg is straightened against the load of the ankle weight. By contrast, the thigh weights work the extensor muscles only when the foot is on the ground and the leg is straightening against their weight. They also work, as was previously discussed, the extensors when the foot is off the ground.

In a running or walking motion, while one foot is off the ground, the other is, except for a very brief instant, on the ground. When ankle weights are worn, only one leg at a time receives resistance, be it to the flexor or extensor muscle groups. The leg that is off the grounds is the leg that gets all the resistance. The flexor muscles are worked as the foot and knee go up initially, and the extensor muscles just above the knee come into play as the foot swings forward, often while still going up.

With thigh weights, both legs are receiving resistance simultaneously. The leg off the grounds is flexing against the weight over its thigh. At least while it is moving upward, and the leg in contact with the ground is extending against the weight over it. Or, more simply put, with thigh weights the flexors of one leg work while the extensors of the other leg do. Such action specific to thigh weights, as compared to ankle weights, is yet another manner in which the thigh weights work the muscles differently.

Of the remaining prior art in the field, only weighted belts and weighted vests are pertinent. The previously mentioned wrist weights and head weights do not apply. It is obvious that neither of them work the legs in any manner to speak of.

Weighted belts and weighted vests are very similar in function. They both overload the trunk of the body for various physical activities. The only major differences between the two are that weighted vests slip over the shoulders, thereby putting some stress on the trapezius dorsi and deltoid muscle groups while the weighted vests may carry their weight a little higher and are often heavier. Certain of the weighted vests, however, carry their weight at the bottom of the unit, right at the abdominal region and very close to where the weighted belt is worn. Also, the weighted vests range from ten (10) to fifty (50) pounds in weight, with most of them at twenty (20) to thirty (30) pounds. The weighted belts go from eight (8) to eighteen (18) pounds, with those in the eight (8) to ten (10) pound range most common. Even though weighted vests are usually heavier than weighted belts, it is not inconceivable for the belts to at times be nearly as heavy, just as heavy, or even heavier.

Like thigh weights, weighted vests and belts work the extensor muscles of the legs. Unlike thigh weights, however, they do not work the flexor muscles of the legs to any extent. This can be witnessed by placing an object weighing around fifteen (15), twenty (20) or thirty (30) pounds on the shoulders, or even securing it around the waist if possible. The weighted object can be, inter alia, a bag of dog food or dry cement mix, or even a small child, or an exercise bar if available. Then the squat exercise is performed against this weight, i.e. merely bending the legs and coming back up against it. Undoubtedly, stress on the extensor muscle will be felt when straightening the legs. Next, utilizing the same resistance, and perhaps grabbing onto something sturdy for balance, flex the thighs. Little if any resistance in your flexor muscle group area will be felt as the knee and foot are brought up off the ground.

It is admitted that the thigh weights do not stress the extensor muscles as severely as the weighted vests and weighted belts which are heavier. Few individuals, however, use such weight to run in, as this very strenuous exercise is only for the fittest. Moreover, the weighted vests and belts do not load the flexor muscles, as discussed. Again, it is the combination of flexor and extensor muscular activity which differentiates the thigh weights from weighted vests and belts, and this uniqueness consequently grants then a superiority in their own right.

Numerous innovations for attachable weight exercise devices have been provided in the prior art that will be described. However, even though these innovations may be suitable for the specific individual purposes to which they address, they differ from the present invention in that they do not teach an attachable weight exercising device that completely encircles the leg, assuring symmetrical development; is supported by the lateral line of the body, in line with the femur, and gravity, therefore there is no forward pull, such as with weight vests and ankle weights, and thus no potential back problems; provides no impact/inertia on the knee ligaments since the weight is supported by the waist belt, eliminating any damaging "pull" that is possible with ankle weights; and has encircling/supported weights that are more ergonomic in design, unlike weights that are on front, or are contained in shorts which will move with inertia.

FOR EXAMPLE, U.S. Pat. No. 4,303,239 to Walsh Jr. teaches a totally adjustable thigh muscle exercise device that includes a belt, which may be adjusted to any user's waist size, and weights suspended from the belt for location at the front of the user's thighs. In the preferred embodiment, the location of the weights along the front of the device may be adjusted to accommodate the individual users needs and the amount of weight may be easily varied, and the space between the belt and the weights may also be adjusted to further accommodate the user or the particular exercise being practiced.

ANOTHER EXAMPLE, U.S. Pat. No. 5,075,902 to McReynolds et al. teaches a weighted training garment that includes a pair of shorts having portions which surround each thigh area of the user supplied with weights contained in a cuff-like device.

STILL ANOTHER EXAMPLE, U.S. Pat. No. 5,102,123 to Roark teaches a device and method for exercising the hamstring/gluteal muscles that includes the steps of providing a weighted means, attaching the weighted means approximate the knee with a fastening means, and performing leg lifts. The weighted means includes a standard dumbbell. The fastening means includes a trap of hook and loop fasteners.

YET ANOTHER EXAMPLE, U.S. Pat. No. 5,144,694 to Conrad Da Oud et al. teaches an exercise or physical therapy apparel that includes a vest, pants, spine strap, belt, wrist bands, ankle bands, and weighted pockets. The vest and pants are each provided with structure for holding at least one weight. The weighted pockets include plural rows and plural columns of weight members adjacent a layer of padding inside of a cloth pouch.

STILL YET ANOTHER EXAMPLE, U.S. Pat. No. 5,169,364 to Donaldson teaches a. weight attachable leg exercise device that includes a generally tubular ankle collar or boot having an inner surface conformingly fitted to a user's ankle region. The outer forward facing surface of the ankle boot includes an upturned j-shaped hook member adapted to receive a weight clip member. The weight clip member includes means for retainingly engaging a rod or bar portion of a conventional weight, such as a dumbbell, and is lockable to the hook member of the boot.

U.S. Pat. No. 4,180,261 to Kolka relating to an Exercising Device for Running. The invention includes a waist belt and a pocketing structure strapped along the front of each leg and suspended by belts to the waist belt. The suspending straps do not permit repetitive resistance exercises and the freedom of movement and hip adjustment are inhibited by the structure of the invention of Kolka. The thigh weights in the pocket structure do not encircle the thigh nor do the support straps evenly distribute their weight.

Element 19 of Kolka is a pad which absorbs shocks generated by up and down motion of the weights as the weights are not securely attached. The present invention provides for immobilizing the weights by completely and securely encircling the thigh so that it does not bounce up and down as does the invention of Kolka.

The invention of Kolka is limited to forward running motion and is unsuitable for aerobic exercises and toning exercises as the weights are not uniformly distributed around the thigh and the support straps attach at a point too far down the leg and the support straps are not rigid enough for aerobic and toning exercise. One would encounter restriction as to body motion and also slippage at the pocket structure during aerobic exercise as well as torque on the leg itself.

It is apparent that numerous innovations for attachable weight exercise devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide an exercise thigh weight system that avoids the disadvantages of the prior art.

ANOTHER OBJECT of the present invention is to provide an exercise thigh weight system that is simple and inexpensive to manufacture.

STILL ANOTHER OBJECT of the present invention is to provide an exercise thigh weight system that is simple to use.

YET ANOTHER OBJECT of the present invention is to provide an exercise thigh weight system that is a toning device for use on the lower body,i.e. the hips, thighs, and buttocks, so that by wearing the present invention and performing various exercises all these muscles can be worked.

STILL YET ANOTHER OBJECT of the present invention is to provide an exercise thigh weight system that will work hip flexors and quadriceps when moving to the front and the gluteus muscles when moving to the rear, by holding onto a chair or table for support and leaning forward and lifting one leg towards the chest, with the knee bending as it comes forward, and then thrusting back and upwards, similar to the motion performed on a BUTT-BLASTER (TM) machine.

YET STILL ANOTHER OBJECT of the present invention is to provide an exercise thigh weight system that will work the abductor muscles on the outside of the leg as well as the side of the gluteus, by performing leg lifts to the side, such as those ordinarily performed weightless or with an ankle/cable attachment.

STILL YET ANOTHER OBJECT of the present invention is to provide an exercise thigh weight system that will work the abductor muscles on the outside of the leg as well as the adductor muscles on the inside of the leg, by lying on the ground and using an opening/closing motion of the legs, with the knees either bent or straight, but with the legs raised to the ceiling.

YET STILL ANOTHER OBJECT of the present invention is to provide an exercise thigh weight system that will work the rectus abdominous muscles of the lower abdomen, by performing a scissor motion while lying on the floor with one leg held straight 12" off the floor, and the other leg is bent to the stomach.

STILL YET ANOTHER OBJECT of the present invention is to provide an exercise thigh weight system that can be utilized during, inter alia, walking, jogging/running, running in place, jumping jacks/calisthenics, ripe jumping, sprinting/jumping, aerobics, step aerobics, floor exercises, dancing/gymnastic exercises, martial arts kicking practice, bicycling, standing muscle toning, and treadmilling, etc.

YET STILL ANOTHER OBJECT of the present invention is to provide an exercise thigh weight system that provides runners, joggers, and sprinters with higher leg lifts and faster push offs, by strengthening their hip flexors and gluteals while running with the present invention on.

STILL YET ANOTHER OBJECT of the present invention is to provide an exercise thigh weight system that provides aerobic athletes with higher heart rates and greater toning, by the added resistance of the present invention, during their usual regime.

YET STILL ANOTHER OBJECT of the present invention is to provide an exercise thigh weight system that allows step classes, in particular, to be taken to a new level of difficulty.

STILL YET ANOTHER OBJECT of the present invention is to provide an exercise thigh weight system that provides martial artists, or for that fact any athlete who uses their legs in a manner that requires speed and power, with tremendous gains in both speed and power, by doing kicking/extension drills while wearing the present invention, since the power of a kick is primarily generated from the hip—a front kick comes up faster and thus strikes harder due to the conditioning of the hip flexors, a side kick uses the hip flexors as well as the abductors in its extension as does a roundhouse kick, a rear kick on the other hand uses a combination of hip flexor to the front and gluteals to the rear, and a crescent kick or axe kick uses a combination of hip flexor, abductor, and adductor.

YET STILL ANOTHER OBJECT of the present invention is to provide an exercise thigh weight system that allows martial artists to improve their kicking speed and strength without the torque and muscle imbalance problems inherent to ankle weights.

STILL YET ANOTHER OBJECT of the present invention is to provide an exercise thigh weight system that allows overweight patients/users, normally unable to sustain a high heart rate for fat metabolism as a result of their size and inability to do cardiovascular exercise, can lose weight, ipso facto, walking with the present invention on.

BRIEFLY STATED, YET STILL ANOTHER OBJECT of the present invention is to provide an exercise thigh weight system that is replaceably attachable to a wearer who has a waist, a right leg with a length and an outside with a centerline, a right hip, a right thigh with an upper portion that has a size and a lower portion that has a size and an inner portion, a right knee, a left leg with a length and an outside with a centerline, a left hip, a left thigh with an upper portion that has a size and a lower portion that has a size and an inner portion, and a left knee, and which provides resistance for the upper portion of the right thigh of the wearer and the upper portion of the left thigh of the wearer during exercising therewith, and that includes a sturdy, semi-rigid, and adjustable waist belt, a right leg harness assembly, right leg harness assembly attaching apparatus, a left leg harness assembly, and left leg harness assembly attaching apparatus.

STILL YET ANOTHER OBJECT of the present invention is to provide an exercise thigh weight system wherein the sturdy, semi-rigid, and adjustable waist belt is adjustably and replaceably positionable around the waist of the wearer, so that adequate support for the wearer is provided.

YET STILL ANOTHER OBJECT of the present invention is to provide an exercise thigh weight system wherein the sturdy, semi-rigid, and adjustable waist belt has a right hip point that is positionable on the right hip of the wearer, a left hip point that is positionable on the left hip of the wearer and thereby being opposed to the right hip point of the sturdy, semi-rigid, and adjustable waist belt, an adjusting buckle for adjusting for different sizes of the waist of the wearer, and containing internal reinforcements.

STILL YET ANOTHER OBJECT of the present invention is to provide an exercise thigh weight system wherein the right leg harness assembly extends vertically downwardly from the right hip point of the sturdy, semi-rigid, and adjustable waist belt and being encirclingly positionable around the right thigh of the wearer.

YET STILL ANOTHER OBJECT of the present invention is to provide an exercise thigh weight system wherein the right leg harness assembly has a weight, and an open-ended and flexible lower weighted strap being encirclingly positionable around only the lower portion of the right thigh of the wearer above the right knee of the wearer with the upper portion of the right thigh of the wearer being free of any weights disposed thereon, so that resistance is provided for the upper portion of the right thigh of the wearer when the right leg of the wearer is flexed, and binding, pinching, and loss of range of motion is prevented.

STILL YET ANOTHER OBJECT of the present invention is to provide an exercise thigh weight system wherein the right leg harness assembly attaching apparatus replaceably attaches the right leg harness assembly to the sturdy, semi-rigid, and adjustable waist belt.

YET STILL ANOTHER OBJECT of the present invention is to provide an exercise thigh weight system wherein the left leg harness assembly extends vertically downwardly from the left hip point of the sturdy, semi-rigid, and adjustable waist belt and being encirclingly positionable around the left thigh of the wearer.

STILL YET ANOTHER OBJECT of the present invention is to provide an exercise thigh weight system wherein the left leg harness assembly is parallel to the right leg harness assembly and at an opposite side of the sturdy, semi-rigid, and adjustable waist belt than that of the right leg harness assembly since the left hip point of the sturdy, semi-rigid, and adjustable waist belt is disposed opposite to the right hip point of the sturdy, semi-rigid, and adjustable waist belt.

YET STILL ANOTHER OBJECT of the present invention is to provide an exercise thigh weight system wherein the left leg harness assembly has a weight, and an open-ended and flexible lower weighted strap being encirclingly positionable around only the lower portion of the left thigh of the wearer above the left knee of the wearer with the upper portion of the left thigh of the wearer being free of any weights disposed thereon, so that resistance is provided for the upper portion of the left thigh of the wearer when the left leg of the wearer is flexed, and binding, pinching, and loss of range of motion is prevented.

STILL YET ANOTHER OBJECT of the present invention is to provide an exercise thigh weight system wherein the left leg harness assembly attaching apparatus replaceably attaches the left leg harness assembly to the sturdy, semi-rigid, and adjustable waist belt.

YET STILL ANOTHER OBJECT of the present invention is to provide an exercise thigh weight system wherein the sturdy, semi-rigid, and adjustable waist belt is selected from the group consisting of thick leather and heavy nylon.

STILL YET ANOTHER OBJECT of the present invention is to provide an exercise thigh weight system wherein the right leg harness assembly attaching apparatus includes a wide and looped weight-bearing strap that loosely encircles, and extends vertically downwardly approximately 1" below, the sturdy, semi-rigid, and adjustable waist belt, at the right hip point of the sturdy, semi-rigid, and adjustable waist belt.

YET STILL ANOTHER OBJECT of the present invention is to provide an exercise thigh weight system wherein the wide and looped weight-bearing strap of the right leg harness assembly attaching apparatus loosely encircles the sturdy, semi-rigid, and adjustable waist belt, so that the wide and looped weight-bearing strap of the right leg harness assembly attaching apparatus can be freely moved along the sturdy, semi-rigid, and adjustable waist belt to the right hip point of the sturdy, semi-rigid, and adjustable waist belt when the sturdy, semi-rigid, and adjustable waist belt is being adjusted to fit around wearers having different size waists.

STILL YET ANOTHER OBJECT of the present invention is to provide an exercise thigh weight system wherein the left leg harness assembly attaching apparatus includes a wide and looped weight-bearing strap that loosely encircles, and extends vertically downwardly approximately 1" below, the sturdy, semi-rigid, and adjustable waist belt, at the left hip point of the sturdy, semi-rigid, and adjustable waist belt.

YET STILL ANOTHER OBJECT of the present invention is to provide an exercise thigh weight system wherein the wide and looped weight-bearing strap of the left leg harness assembly attaching apparatus loosely encircles the sturdy, semi-rigid, and adjustable waist belt, so that the wide and looped weight-bearing strap of the left leg harness assembly attaching apparatus can be freely moved along the sturdy, semi-rigid, and adjustable waist belt to the left hip point of the sturdy, semi-rigid, and adjustable waist belt when the sturdy, semi-rigid, and adjustable waist belt is being adjusted to fit around wearers having different size waists.

STILL YET ANOTHER OBJECT of the present invention is to provide an exercise thigh weight system wherein the wide and looped weight-bearing strap of the right leg harness assembly attaching apparatus is wide and made of heavy ballistic nylon, so that the weight of the right leg harness assembly can be amply supported and distributed over a wider portion of the sturdy, semi-rigid, and adjustable waist belt and thereby reduce possible failure of, and reduce possible pulling downwardly from the waist of the wearer of, the sturdy, semi-rigid, and adjustable waist belt as a result of the weight of the right leg harness assembly.

YET STILL ANOTHER OBJECT of the present invention is to provide an exercise thigh weight system wherein the wide and looped weight-bearing strap of the left leg harness assembly attaching apparatus is wide and made of heavy ballistic nylon, so that the weight of the left leg harness assembly can be amply supported and distributed over a wider portion of the sturdy, semi-rigid, and adjustable waist belt and thereby reduce possible failure of, and reduce possible pulling downwardly from the waist of the wearer of, the sturdy, semi-rigid, and adjustable waist belt as a result of the weight of the left leg harness assembly.

STILL YET ANOTHER OBJECT of the present invention is to provide an exercise thigh weight system wherein the right leg harness assembly attaching apparatus further includes a steel ring that captures and encircles the wide and looped weight-bearing strap of the right leg harness assembly attaching means, at a position below the sturdy, semi-rigid, and adjustable waist belt.

YET STILL ANOTHER OBJECT of the present invention is to provide an exercise thigh weight system wherein the left leg harness assembly attaching apparatus further includes a steel ring that captures and encircles the wide and looped weight-bearing strap of the left leg harness assembly attaching means, at a position below the sturdy, semi-rigid, and adjustable waist belt.

STILL YET ANOTHER OBJECT of the present invention is to provide an exercise thigh weight system wherein the right leg harness assembly attaching apparatus further includes an adjustable strap that has a length and captures, encircles, and extends vertically downwardly from, the steel ring of the right leg harness assembly attaching apparatus, at a position below the wide and looped weight-bearing strap of the right leg harness assembly attaching apparatus.

YET STILL ANOTHER OBJECT of the present invention is to provide an exercise thigh weight system wherein the left leg harness assembly attaching apparatus further includes an adjustable strap that has a length and captures, encircles, and extends vertically downwardly from, the steel ring of the left leg harness assembly attaching apparatus, at a position below the wide and looped weight-bearing strap of the left leg harness assembly attaching apparatus.

STILL YET ANOTHER OBJECT of the present invention is to provide an exercise thigh weight system wherein the adjustable strap of the right leg harness assembly attaching apparatus is nylon webbing.

YET STILL ANOTHER OBJECT of the present invention is to provide an exercise thigh weight system wherein the adjustable strap of the left leg harness assembly attaching apparatus is nylon webbing.

STILL YET ANOTHER OBJECT of the present invention is to provide an exercise thigh weight system wherein the right leg harness assembly attaching apparatus further includes a tension clip that is movable along the adjustable strap of the right leg harness assembly attaching apparatus and adjusts the length thereof from approximately 1–6", so that the right leg harness assembly can be properly positioned on the right thigh of the wearer regardless of the length of the right leg of the wearer.

YET STILL ANOTHER OBJECT of the present invention is to provide an exercise thigh weight system wherein the left leg harness assembly attaching apparatus further includes a tension clip that is movable along the adjustable strap of the left leg harness assembly attaching apparatus and adjusts the length thereof from approximately 1–6", so that the left leg harness assembly can be properly positioned on the left thigh of the wearer regardless of the length of the left leg of the wearer.

STILL YET ANOTHER OBJECT of the present invention is to provide an exercise thigh weight system wherein the right leg harness assembly includes a semi-rigid, elongated, and generally rectangular-shaped side support rod that is positionable along the centerline of the outside of the right leg of the wearer and has an upper end which extends vertically downwardly from the adjustable strap of the right leg harness assembly attaching apparatus, and a lower end which is disposed vertically below the upper end of the semi-rigid, elongated, and generally rectangular-shaped side support rod of the right leg harness assembly.

YET STILL ANOTHER OBJECT of the present invention is to provide an exercise thigh weight system wherein the left leg harness assembly includes a semi-rigid, elongated, and generally rectangular-shaped side support rod that is positionable along the centerline of the outside of the left leg of the wearer and has an upper end which extends vertically downwardly from the adjustable strap of the left leg harness assembly attaching apparatus, and a lower end which is disposed vertically below the upper end of the semi-rigid, elongated, and generally rectangular-shaped side support rod of the left leg harness assembly.

STILL YET ANOTHER OBJECT of the present invention is to provide an exercise thigh weight system wherein the semi-rigid, elongated, and generally rectangular-shaped side support rod of the right leg harness assembly is approximately 10" long, is made of unbreakable plastic, and is covered with a thick layer of padding which in turn is covered with layers of material selected from the group consisting of vinyl and nylon, so that the centerline of the outside of the right leg of the wearer is cushioned from direct contact with the semi-rigid, elongated, and generally rectangular-shaped side support rod of the right leg harness assembly.

YET STILL ANOTHER OBJECT of the present invention is to provide an exercise thigh weight system wherein the semi-rigid, elongated, and generally rectangular-shaped side support rod of the left leg harness assembly is approximately 10" long, is made of unbreakable plastic, and is covered with a thick layer of padding which in turn is covered with layers of material selected from the group consisting of vinyl and nylon, so that the centerline of the outside of the left leg of the wearer is cushioned from direct contact with the semi-rigid, elongated, and generally rectangular-shaped side support rod of the left leg harness assembly.

STILL YET ANOTHER OBJECT of the present invention is to provide an exercise thigh weight system wherein the right leg harness assembly further includes a semi-rigid, horizontally-oriented, and generally C-shaped support that has a pair of legs with free ends, and a midpoint that is disposed equidistantly between the free ends of the pair of legs of the semi-rigid, horizontally-oriented, and generally C-shaped support of the right leg harness assembly.

YET STILL ANOTHER OBJECT of the present invention is to provide an exercise thigh weight system wherein the semi-rigid, horizontally-oriented, and generally C-shaped support of the right leg harness assembly extends perpendicularly horizontally inwardly from the semi-rigid, elongated, and generally rectangular-shaped side support rod of the right leg harness assembly, with the midpoint of the semi-rigid, horizontally-oriented, and generally C-shaped support of the right leg harness assembly being coincident with the lower end of the semi-rigid, elongated, and generally rectangular-shaped side support rod of the right leg harness assembly, and with the free ends of the pair of legs of the semi-rigid, horizontally-oriented, and generally C-shaped support of the right leg harness assembly extending approximately 6" inwardly therefrom.

STILL YET ANOTHER OBJECT of the present invention is to provide an exercise thigh weight system wherein the left leg harness assembly further includes a semi-rigid, horizontally-oriented, and generally C-shaped support that has a pair of legs with free ends, and a midpoint that is disposed equidistantly between the free ends of the pair of legs of the semi-rigid, horizontally-oriented, and generally C-shaped support of the left leg harness assembly.

YET STILL ANOTHER OBJECT of the present invention is to provide an exercise thigh weight system wherein the semi-rigid, horizontally-oriented, and generally C-shaped support of the left leg harness assembly extends perpendicularly horizontally inwardly from the semi-rigid, elongated, and generally rectangular-shaped side support rod of the left leg harness assembly, with the midpoint of the semi-rigid, horizontally-oriented, and generally C-shaped support of the left leg harness assembly being coincident with the lower end of the semi-rigid, elongated, and generally rectangular-shaped side support rod of the left leg harness assembly, and with the free ends of the pair of legs of the semi-rigid, horizontally-oriented, and generally C-shaped support of the left leg harness assembly extending approximately 6" inwardly therefrom.

STILL YET ANOTHER OBJECT of the present invention is to provide an exercise thigh weight system wherein the semi-rigid, horizontally-oriented, and generally C-shaped support of the right leg harness assembly is unbreakable plastic and is integrally molded with the semi-rigid, elongated, and generally rectangular-shaped side support rod of the right leg harness assembly, so that a continuous and strong support is provided.

YET STILL ANOTHER OBJECT of the present invention is to provide an exercise thigh weight system wherein the semi-rigid, horizontally-oriented, and generally C-shaped support of the left leg harness assembly is unbreakable plastic and is integrally molded with the semi-rigid, elongated, and generally rectangular-shaped side support rod of the left leg harness assembly, so that a continuous and strong support is provided.

STILL YET ANOTHER OBJECT of the present invention is to provide an exercise thigh weight system wherein the right leg harness assembly further includes an open-ended and flexible upper strap that extends horizontally inwardly from the upper end of the semi-rigid, elongated, and generally rectangular-shaped side support rod of the right leg harness assembly, has a pair of free ends, and is encirclingly positionable around the upper portion of the right thigh of the wearer, in proximity to the right hip of the wearer.

YET STILL ANOTHER OBJECT of the present invention is to provide an exercise thigh weight system wherein the open-ended and flexible upper strap of the right leg harness assembly is open ended, so that the right leg harness assembly can be easily attached to the upper portion of the right thigh of the wearer without the wearer having to raise the right leg of the wearer and the right leg harness assembly can be properly adjustably positioned on the upper portion of the right thigh of the wearer regardless of the size of the upper portion of the right thigh of the wearer.

STILL YET ANOTHER OBJECT of the present invention is to provide an exercise thigh weight system wherein the left leg harness assembly further includes an open-ended and flexible upper strap that extends horizontally inwardly from the upper end of the semi-rigid, elongated, and generally rectangular-shaped side support rod of the left leg harness assembly, has a pair of free ends, and is encirclingly positionable around the upper portion of the left thigh of the wearer, in proximity to the left hip of the wearer.

YET STILL ANOTHER OBJECT of the present invention is to provide an exercise thigh weight system wherein the open-ended and flexible upper strap of the left leg harness assembly is open ended, so that the left leg harness assembly can be easily attached to the upper portion of the left thigh of the wearer without the wearer having to raise the left leg of the wearer and the left leg harness assembly can be properly adjustably positioned on the upper portion of the left thigh of the wearer regardless of the size of the upper portion of the left thigh of the wearer.

STILL YET ANOTHER OBJECT of the present invention is to provide an exercise thigh weight system wherein the open-ended and flexible upper strap of the right leg harness assembly is sturdy nylon webbing, and has disposed on the pair of free ends thereof, complementary portions of hook and loop fasteners, so that the open-ended and flexible upper strap of the right leg harness assembly can be releasibly maintained around the upper portion of the right thigh of the wearer.

YET STILL ANOTHER OBJECT of the present invention is to provide an exercise thigh weight system wherein the open-ended and flexible upper strap of the left leg harness assembly is sturdy nylon webbing, and has disposed on the pair of free ends thereof, complementary portions of hook and loop fasteners, so that the open-ended and flexible upper strap of the left leg harness assembly can be releasibly maintained around the upper portion of the left thigh of the wearer.

STILL YET ANOTHER OBJECT of the present invention is to provide an exercise thigh weight system wherein the open-ended and flexible lower weighted strap of the right leg harness assembly extends horizontally inwardly from the lower end of the semi-rigid, elongated, and generally rectangular-shaped side support rod of the right leg harness assembly, and has a pair of free ends.

YET STILL ANOTHER OBJECT of the present invention is to provide an exercise thigh weight system wherein the open-ended and flexible lower weighted strap of the right leg harness assembly is open ended, so that the right leg harness assembly can be easily attached to the lower portion of the right thigh of the wearer without the wearer having to raise the right leg of the wearer and the right leg harness assembly can be properly adjustably positioned on the lower portion of the right thigh of the wearer regardless of the size of the lower portion of the right thigh of the wearer.

STILL YET ANOTHER OBJECT of the present invention is to provide an exercise thigh weight system wherein the open-ended and flexible lower weighted strap of the left leg harness assembly extends horizontally inwardly from the lower end of the semi-rigid, elongated, and generally rectangular-shaped side support rod of the left leg harness assembly, and has a pair of free ends.

YET STILL ANOTHER OBJECT of the present invention is to provide an exercise thigh weight system wherein the open-ended and flexible lower weighted strap of the left leg harness assembly is open ended, so that the left leg harness assembly can be easily attached to the lower portion of the left thigh of the wearer without the wearer having to raise the left leg of the wearer and the left leg harness assembly can be properly adjustably positioned on the lower portion of the left thigh of the wearer regardless of the size of the lower portion of the left thigh of the wearer.

STILL YET ANOTHER OBJECT of the present invention is to provide an exercise thigh weight system wherein the open-ended and flexible lower weighted strap of the right leg harness assembly is two sheets of opposing and generally rectangular-shaped flexible material that have a periphery, is filled therebetween with lead shot, and is sewn along the periphery thereof and vertically in intervals therealong so as to produce a plurality of individual segmented pockets of weights that has a weight, so that the weight of the plurality of individual segmented pockets of weight of the open-ended and flexible lower weighted strap of the right leg harness assembly is distributed evenly around the lower portion of the right thigh of the wearer and thereby providing resistance for the upper portion of the right thigh of the wearer during usage thereof while allowing increased speed of the right leg of the wearer as a result of the overall positioning of the exercise thigh weight system.

YET STILL ANOTHER OBJECT of the present invention is to provide an exercise thigh weight system wherein the open-ended and flexible lower weighted strap of the left leg harness assembly is two sheets of opposing and generally rectangular-shaped flexible material that have a periphery, is filled therebetween with lead shot, and is sewn along the periphery thereof and vertically in intervals therealong so as to produce a plurality of individual segmented pockets of weights that has a weight, so that the weight of the plurality of individual segmented pockets of weight of the open-ended and flexible lower weighted strap of the left leg harness assembly is distributed evenly around the lower portion of the left thigh of the wearer and thereby providing resistance for the upper portion of the left thigh of the wearer during usage thereof while allowing increased speed of the left leg of the wearer as a result of the overall positioning of the exercise thigh weight system.

STILL YET ANOTHER OBJECT of the present invention is to provide an exercise thigh weight system wherein the open-ended and flexible lower weighted strap of the right leg harness assembly further includes a tension ring that is disposed on one free end of the pair of free ends of the open-ended and flexible lower weighted strap of the right leg harness assembly.

YET STILL ANOTHER OBJECT of the present invention is to provide an exercise thigh weight system wherein the open-ended and flexible lower weighted strap of the left leg harness assembly further includes a tension ring that is disposed on one free end of the pair of free ends of the open-ended and flexible lower weighted strap of the left leg harness assembly.

STILL YET ANOTHER OBJECT of the present invention is to provide an exercise thigh weight system wherein the open-ended and flexible lower weighted strap of the right leg harness assembly further includes a hook and loop fastener coated mini-strap that has complementary portions of hook and loop fasteners disposed adjacent to each other on an outer side thereof, and extends outwardly from another free end of the pair of free ends of the open-ended and flexible lower weighted strap of the right leg harness assembly.

YET STILL ANOTHER OBJECT of the present invention is to provide an exercise thigh weight system wherein the hook and loop fastener coated mini-strap of the another free end of the pair of free ends of the open-ended and flexible lower weighted strap of the right leg harness assembly passes freely through the tension ring of the one free end of the pair of free ends of the open-ended and flexible lower weighted strap of the right leg harness assembly, and doubles back on itself, with the complementary portions of the hook and loop fasteners of the hook and loop fastener coated mini-strap of the another free end of the pair of free ends of the open-ended and flexible lower weighted strap of the right leg harness assembly engaging each other, so that the open-ended and flexible lower weighted strap of the right leg harness assembly can be releasibly maintained around the lower portion of the right thigh of the wearer.

STILL YET ANOTHER OBJECT of the present invention is to provide an exercise thigh weight system wherein the open-ended and flexible lower weighted strap of the left leg harness assembly further includes a hook and loop fastener coated mini-strap that has complementary portions of hook and loop fasteners disposed adjacent to each other on an outer side thereof, and extends outwardly from another free end of the pair of free ends of the open-ended and flexible lower weighted strap of the left leg harness assembly.

YET STILL ANOTHER OBJECT of the present invention is to provide an exercise thigh weight system wherein the hook and loop fastener coated mini-strap of the another free end of the pair of free ends of the open-ended and flexible lower weighted strap of the left leg harness assembly passes freely through the tension ring of the one free end of the pair of free ends of the open-ended and flexible lower weighted strap of the left leg harness assembly, and doubles back on itself, with the complementary portions of the hook and loop fasteners of the hook and loop fastener coated mini-strap of the another free end of the pair of free ends of the open-ended and flexible lower weighted strap of the left leg harness assembly engaging each other, so that the open-ended and flexible lower weighted strap of the left leg harness assembly can be releasibly maintained around the lower portion of the left thigh of the wearer.

STILL YET ANOTHER OBJECT of the present invention is to provide an exercise thigh weight system wherein an outermost sheet of the two sheets of opposing and generally rectangular-shaped flexible material of the open-ended and flexible lower weighted strap of the right leg harness assembly has disposed thereon, on both sides of the semi-rigid, elongated, and generally rectangular-shaped side support rod of the right leg harness assembly, a plurality of spaced-apart and vertically-oriented loops.

YET STILL ANOTHER OBJECT of the present invention is to provide an exercise thigh weight system wherein the plurality of spaced-apart and vertically-oriented loops of the outermost sheet of the two sheets of opposing and generally rectangular-shaped flexible material of the open-ended and flexible lower weighted strap of the right leg harness assembly releasibly and snugly receive the pair of legs of the semi-rigid, horizontally-oriented, and generally C-shaped support of the right leg harness assembly, with the open-ended and flexible lower weighted strap of the right leg harness assembly snugly abutted against the semi-rigid, horizontally-oriented, and generally C-shaped support of the right leg harness assembly, and with the free ends of the pair of legs of the right leg harness assembly semi-rigid, horizontally-oriented, and generally C-shaped support of the right leg harness assembly terminating slightly prior to the pair of free ends of the open-ended and flexible lower weighted strap of the right leg harness assembly, so that the open-ended and flexible lower weighted strap of the right leg harness assembly is kept stable and prevented from sagging on the inner portion of the right thigh of the wearer and from slipping downwardly from the right thigh of the wearer during prolonged exercise.

STILL YET ANOTHER OBJECT of the present invention is to provide an exercise thigh weight system wherein an outermost sheet of the two sheets of opposing and generally rectangular-shaped flexible material of the open-ended and flexible lower weighted strap of the left leg harness assembly has disposed thereon, on both sides of the semi-rigid, elongated, and generally rectangular-shaped side support rod of the left leg harness assembly, a plurality of spaced-apart and vertically-oriented loops.

YET STILL ANOTHER OBJECT of the present invention is to provide an exercise thigh weight system wherein the plurality of spaced-apart and vertically-oriented loops of the outermost sheet of the two sheets of opposing and generally rectangular-shaped flexible material of the open-ended and flexible lower weighted strap of the left leg harness assembly releasibly and snugly receive the pair of legs of the semi-rigid, horizontally-oriented, and generally C-shaped support of the left leg harness assembly, with the open-ended and flexible lower weighted strap of the left leg harness assembly snugly abutted against the semi-rigid, horizontally-oriented, and generally C-shaped support of the left leg harness assembly, and with the free ends of the pair of legs of the left leg harness assembly semi-rigid, horizontally-oriented, and generally C-shaped support of the left leg harness assembly terminating slightly prior to the pair of free ends of the open-ended and flexible lower weighted strap of the left leg harness assembly, so that the open-ended and flexible lower weighted strap of the left leg harness assembly is kept stable and prevented from sagging on the inner portion of the left thigh of the wearer and from slipping downwardly from the left thigh of the wearer during prolonged exercise.

FINALLY, STILL YET ANOTHER OBJECT of the present invention is to provide a method of donning an exercise thigh weight system that includes the steps of attaching a sturdy, semi-rigid, and adjustable waist belt of the exercise thigh weight system around a waist of a wearer, ascertaining that the sturdy, semi-rigid, and adjustable waist belt is properly in place, ascertaining that a semi-rigid, elongated, the generally rectangular-shaped side support rod of a right leg harness assembly of the exercise thigh weight system is aligned along a centerline of an outside of a right thigh of the wearer, ascertaining that a semi-rigid, elongated, the generally rectangular-shaped side support rod of a left leg harness assembly of the exercise thigh weight system is aligned along a centerline of an outside of a left thigh of the wearer, positioning a wide and looped weight-bearing strap of right leg harness assembly attaching apparatus of the exercise thigh weight system on the sturdy, semi-rigid, and adjustable waist belt at a right hip point of the sturdy, semi-rigid, and adjustable waist belt, positioning a wide and looped weight-bearing strap of a left leg harness assembly attaching apparatus of the exercise thigh weight system on the sturdy, semi-rigid, and adjustable waist belt at a left hip point of the sturdy, semi-rigid, and adjustable waist belt, adjusting an adjustable strap of the right leg harness assembly attaching apparatus, by use of an adjusting tension clip of the right leg harness assembly attaching apparatus, until an open-ended and flexible lower weighted strap of the right leg harness assembly is positioned several inches above a right knee of the wearer, so that binding, pinching, and loss of range of motion is prevented, adjusting an adjustable strap of the left leg harness assembly attaching apparatus, by use of an adjusting tension clip of the left leg harness assembly attaching apparatus, until an open-ended and flexible lower weighted strap of the left leg harness assembly is positioned several inches above a left knee of the user, so that binding, pinching, and loss of range of motion is prevented, wrapping an open-ended and flexible upper strap of the right leg harness assembly snugly around an upper portion of the right thigh of the wearer, maintaining the open-ended and flexible upper strap of the right leg harness assembly snugly around the upper portion of the right thigh of the wearer by engaging complementary portions of hook and loop fasteners of a pair of free ends of the flexible upper strap of the right leg harness assembly with each other, wrapping an open-ended and flexible upper strap of the left leg harness assembly snugly around an upper portion of the left thigh of the wearer, maintaining the open-ended and flexible upper strap of the left leg harness assembly snugly around the upper portion of the left thigh of the wearer by engaging complementary portions of hook and loop fasteners of a pair of free ends of the flexible upper strap of the left leg harness assembly with each other, wrapping the open-ended and flexible lower weighted strap of the right leg harness assembly snugly around the lower portion of the right thigh of the wearer, maintaining the open-ended and flexible lower weighted strap of the right leg harness assembly snugly around the lower portion of the right thigh of the wearer by passing a hook and loop fastener coated mini-strap of one free end of a pair of free ends of the open-ended and flexible lower weighted strap of the right leg harness assembly freely through a tension ring of another free end of the pair of free ends of the open-ended and flexible lower weighted strap of the right leg harness assembly and doubling back on itself with complementary portions of hook and loop fasteners of the lower weighted strap hook and loop fastener coated mini-strap of the one free end of the pair of free ends of the open-ended and flexible lower weighted strap of the right leg harness assembly engaging each other, wrapping the open-ended and flexible lower weighted strap of the left leg harness assembly snugly around the lower portion of the left thigh of the wearer, and maintaining the open-ended and flexible lower weighted strap of the left leg harness assembly snugly around the lower portion of the left thigh of the wearer by passing a hook and loop fastener coated mini-strap of one free end of a pair of free ends of the open-ended and flexible lower weighted strap of the left leg harness assembly freely through a tension ring of another free end of the pair of free ends of the open-ended and flexible lower weighted strap of the left leg harness assembly and doubling back on itself with complementary portions of hook and loop fasteners of the hook and loop fastener coated mini-strap of the one free end of the pair of free ends of the open-ended and flexible lower weighted strap of the left leg harness assembly engaging each other.

It is further an object of the invention to provide an invention with support straps designed to keep the weights from sagging in the inner thigh region and which rather than run the length of the thigh, terminate at a point where the upper thigh straps begin at the very top of the thigh where the leg joins the trunk of the body. Such an object is achieved in part by providing an invention formed by the rigidity of a heavy nylon webbing forming a back portion and skin contact part of the weight assembly and by support straps that provide for freedom of movement and hip adjustment as well as weight bearing. The invention utilizes semi-rigid support rods or bridging members or harnessing assemblies which run along the lateral line of the body, directly on line with the femur. These rods, which are adjustable with respect to thigh length, preferably by straps, and the two straps encircle the thigh to provide stable weight management.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIGS. 7–13 illustrate other embodiments of the present invention in which:

FIG. 8 illustrates an embodiment of the invention in which snaps for securing weight packet strap around the thigh to the semi-rigid supporting strap or bridging member of the invention;

FIG. 9 illustrates an alternative embodiment to FIG. 8 in which the securing buckle mechanism of the invention is used;

FIGS. 10–13 show different embodiments of weights secured around the waist band of the invention; and FIGS. 14 and 15 illustrate another embodiment of the present invention in which weight carrying means 160 preferably formed as a weight carrying pouch 161, are supported by being fixedly connected to the bridging member 139 and the lower thigh belt 132, in which:

FIG. 14 is a perspective view of an embodiment of the present invention; and FIG. 15 is a partially exploded view of the embodiment of the invention of FIG. 15.

LIST OF REFERENCE NUMERALS UTILIZED IN THE DRAWING

| | |
|---|---|
| 10 | exercise thigh weight system of the present invention |
| 12 | wearer waist |
| 14 | wearer |
| 16 | wearer hips |
| 18 | wearer leg abductor muscles |
| 20 | wearer legs |
| 22 | wearer thighs |
| 24 | wearer knees |
| 26 | sturdy, semi-rigid, and adjustable waist belt |
| 28 | waist belt right hip point |
| 29 | waist belt left hip point |
| 30 | waist belt front waist adjusting buckle |
| 32 | waist belt internal reinforcements |
| 34 | right leg harness assembly |
| 36 | right leg harness assembly attaching sub-assembly |
| 38 | left leg harness assembly |
| 40 | left leg harness assembly attaching sub-assembly |
| 42 | right leg harness assembly attaching sub-assembly wide and looped weight-bearing strap |
| 44 | right leg harness assembly attaching sub-assembly steel ring |
| 46 | right leg harness assembly attaching sub-assembly adjustable strap |
| 48 | right leg harness assembly attaching sub-assembly adjusting tension clip |
| 50 | right leg harness assembly semi-rigid, elongated, and generally rectangular-shaped side support rod |
| 52 | right leg harness assembly side support rod upper end |
| 54 | right leg harness assembly side support rod lower end |
| 56 | right leg harness assembly side support rod thick layer of padding |
| 58 | right leg harness assembly side support rod layers of vinyl or nylon |
| 60 | right leg harness assembly semi-rigid and generally C-shaped support |
| 61 | right leg harness assembly generally C-shaped support pair of legs |
| 62 | right leg harness assembly generally C-shaped support legs pair of free ends |
| 64 | right leg harness assembly generally C-shaped support midpoint |
| 66 | right leg harness assembly open-ended and flexible upper strap |
| 68 | pair of right leg harness assembly upper strap free ends |
| 70 | right leg harness assembly upper strap free ends complementary portions of hook and loop fasteners |
| 72 | right leg harness assembly open-ended and flexible lower weighted strap |
| 74 | pair of right leg harness assembly lower strap free ends |
| 76 | two sheets of opposing and generally rectangular-shaped flexible material |
| 78 | right leg harness assembly lower weighted strap plurality of individual segmented pockets of weight |
| 80 | right leg harness assembly lower weighted strap tension ring |
| 82 | right leg harness assembly lower weighted strap hook and loop fastener coated mini-strap |
| 84 | outermost sheet plurality of spaced-apart and vertically-oriented loops |

DETAILED DESCRIPTION OF THE PREFERRED EMBODIMENT

Figure 1:
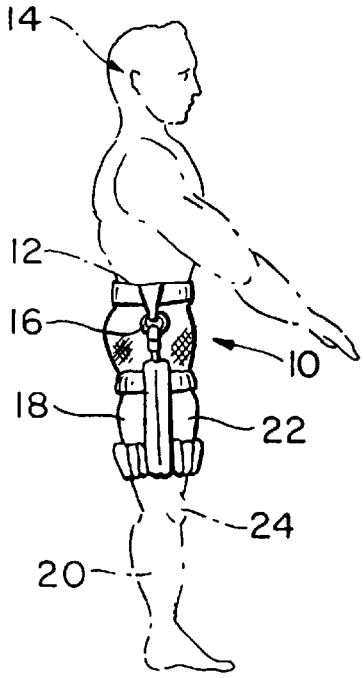
FIG. 1 is a diagrammatic side elevational view illustrating the present invention donned on a wearer.
Figure 2:
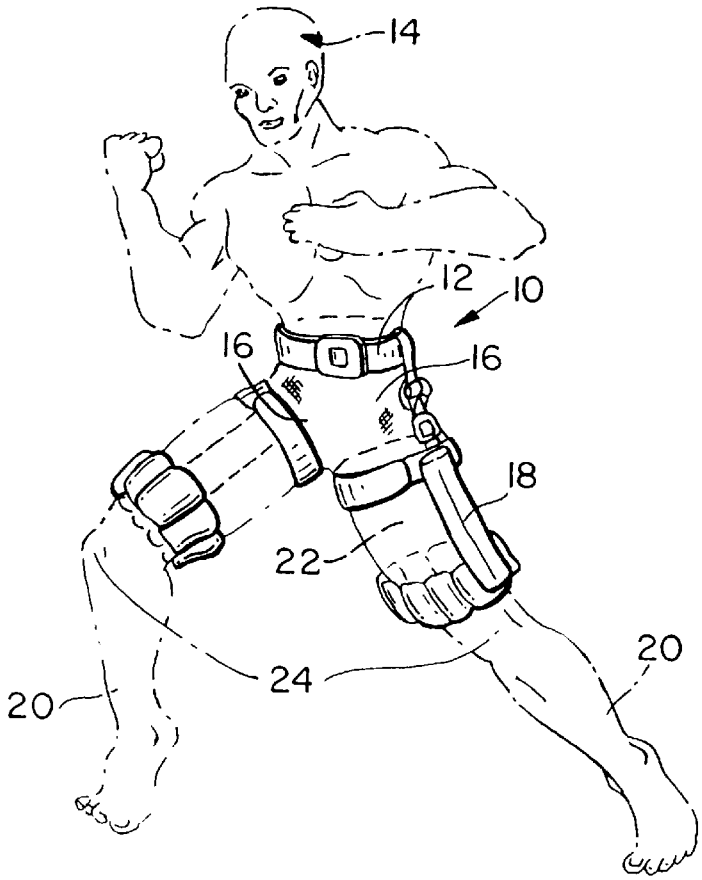
FIG. 2 is a diagrammatic perspective view illustrating the present invention being used by the wearer.

Referring now to the figures in which like numerals indicate like parts, and particularly to FIGS. 1 and 2, which are a diagrammatic side elevational view illustrating the present invention donned on a wearer, and a diagrammatic perspective view illustrating the present invention being used by the wearer, respectively, the exercise thigh weight system of the present invention is shown generally at 10 adjustably and replaceably secured around a wearer waist 12 of a wearer 14, extending vertically downwardly along wearer hips 16 and wearer leg abductor muscles 18 on the centerline of the outside of wearer legs 20 of the wearer 14, encircling wearer thighs 22 of the wearer legs 20 of the wearer 14, and terminating above wearer knees 24 of the wearer legs 20 of the wearer 14.

Figure 3:
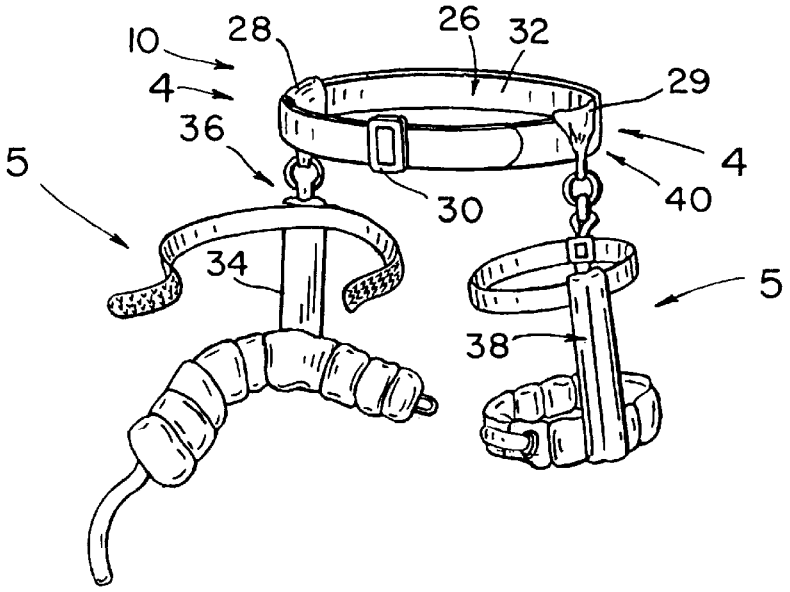
FIG. 3 is an enlarged diagrammatic perspective view of the present invention.

The general configuration of the exercise thigh weight system 10 can best be seen in FIG. 3, which is an enlarged diagrammatic perspective view of the present invention, and as such will be discussed with reference thereto.

The exercise thigh weight system 10 includes a sturdy, semi-rigid, and adjustable waist belt 26 that is adjustably and replaceably positionable around the wearer waist 12 of the wearer 14 and is of a design similar to that of a leather weight lifters belt, so that adequate support for the wearer 12 is provided.

The sturdy, semi-rigid, and adjustable waist belt 26 has a waist belt right hip point 28 that is positionable at the right hip of the wearer hips 16 of the wearer 14, a waist belt left hip point 29 that is positionable at the left hip of the wearer hips 16 of the wearer 14 and thereby opposing the waist belt right hip point 28 of the sturdy, semi-rigid, and adjustable waist belt 26, a waist belt front waist adjusting buckle 30 for adjusting for different sizes of the wearer waist 12 of the wearer 14, and contains waist belt internal reinforcements 32.

The sturdy, semi-rigid, and adjustable waist belt 26 is preferably made of thick leather or heavy nylon.

The exercise thigh weight system 10 further includes a right leg harness assembly 34 that extends vertically downwardly from the waist belt right hip point 28 of the sturdy, semi-rigid, and adjustable waist belt 26, by a right leg harness assembly attaching sub-assembly 36, and is encirclingly positionable around the right thigh of the wearer thighs 22 of the right leg of the wearer legs 20 of the wearer 14.

The exercise thigh weight system 10 further includes a left leg harness assembly 38 that extends vertically downwardly from the waist belt left hip point 29 of the sturdy, semi-rigid, and adjustable waist belt 26, by a left leg harness assembly attaching sub-assembly 40, and is encirclingly positionable around the left thigh of the wearer thighs 22 of the left leg of the wearer legs 20 of the wearer 14.

The left leg harness assembly 38 is disposed parallel to the right leg harness assembly 34 and at an opposite side of the sturdy, semi-rigid, and adjustable waist belt 26 than that of the right leg harness assembly 34, ipso facto, that the waist belt left hip point 29 of the sturdy, semi-rigid, and adjustable waist belt 26 is disposed opposite to the waist belt right hip point 28 of the sturdy, semi-rigid, and adjustable waist belt 26.

Figure 4:
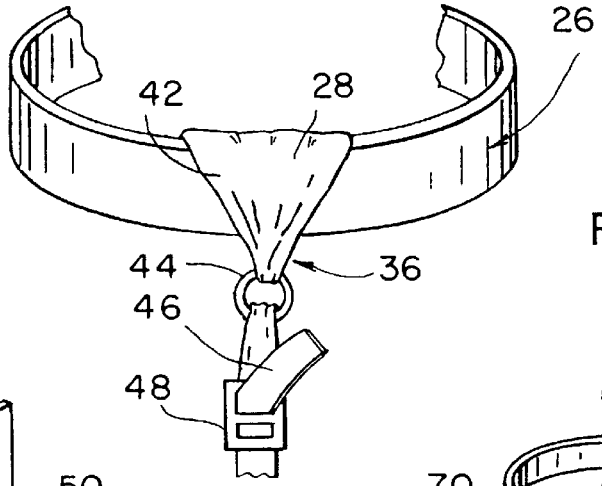
FIG. 4 is an enlarged diagrammatic perspective view, with parts broken away, of the dotted areas identified generally by arrows 4 in FIG. 3.

The specific configuration of the right leg harness assembly attaching sub-assembly 36 can best be seen in FIG. 4, which is an enlarged diagrammatic perspective view, with parts broken away, of the dotted areas identified generally by arrows 4 in FIG. 3, and as such will be discussed with reference thereto.

It is to be understood, however, that the configuration and operation of the left leg harness assembly attaching sub-assembly 40 is identical to that of the right leg harness assembly attaching sub-assembly 36, therefore, for the sake of brevity, only the right leg harness assembly attaching sub-assembly 36 will be discussed.

The right leg harness assembly attaching sub-assembly 36 includes a right leg harness assembly attaching sub-assembly wide and looped weight-bearing strap 42 that loosely encircles, and extends vertically downwardly approximately 1" below, the sturdy, semi-rigid, and adjustable waist belt 26, at the waist belt right hip point 28 of the sturdy, semi-rigid, and adjustable waist belt 26.

The right leg harness assembly attaching sub-assembly wide and looped weight-bearing strap 42 of the right leg harness assembly attaching sub-assembly 36 loosely encircles the sturdy, semi-rigid, and adjustable waist belt 26, so that the right leg harness assembly attaching sub-assembly wide and looped weight-bearing strap 42 of the right leg harness assembly attaching sub-assembly 36 can be freely moved along the sturdy, semi-rigid, and adjustable waist belt 26 to the appropriate waist belt right hip point 28 of the sturdy, semi-rigid, and adjustable waist belt 26 when the sturdy, semi-rigid, and adjustable waist belt 26 is being adjusted to fit around the wearer waist 12 of the wearer 14.

The right leg harness assembly attaching sub-assembly wide and looped weight-bearing strap 42 of the right leg harness attaching sub-assembly 36 is wide and preferably made of heavy ballistic nylon, so that the weight of the right leg harness assembly 34 can be amply supported and distributed over a wider portion of the sturdy, semi-rigid, and adjustable waist belt 26 and thereby reduce the chance of failure thereof while reducing the chance of the sturdy, semi-rigid, and adjustable waist belt 26 being pulled downwardly from the wearer waist 12 of the wearer, ipso facto, the weight of the right leg harness assembly 34.

The right leg harness assembly attaching sub-assembly 36 further includes a right leg harness assembly attaching sub-assembly steel ring 44 that captures and encircles the right leg harness assembly attaching sub-assembly wide and looped weight-bearing strap 42 of the right leg harness assembly attaching sub-assembly 36, at a position below the sturdy, semi-rigid, and adjustable waist belt 26.

The right leg harness assembly attaching sub-assembly 36 further includes a right leg harness assembly attaching sub-assembly adjustable strap 46 that captures, encircles, and extends vertically downwardly from, the right leg harness assembly attaching sub-assembly steel ring 44 of the right leg harness assembly attaching sub-assembly 36, at a position below the right leg harness assembly attaching sub-assembly wide and looped weight-bearing strap 42 of the right leg harness assembly attaching sub-assembly 36.

The right leg harness assembly attaching sub-assembly adjustable strap 46 of the right leg harness assembly attaching sub-assembly 36 is preferably nylon webbing.

The right leg harness assembly attaching sub-assembly 36 further includes a right leg harness assembly attaching sub-assembly adjusting tension clip 48 that is movable along the right leg harness assembly attaching sub-assembly adjustable strap 46 of the right leg harness assembly attaching sub-assembly 36 and adjusts the length thereof from 1–6", so that the right leg harness assembly 34 can be properly positioned on the right thigh of the wearer thighs 22 of the right leg of the wearer legs 20 of the wearer 14 regardless of the length of the right leg of the wearer legs 20 of the wearer 14.

Figure 6:
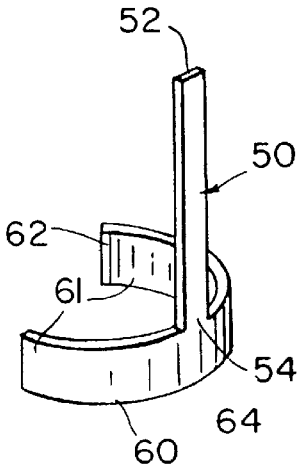
FIG. 6 is an enlarged diagrammatic perspective view, with parts broken away, of a molded support member utilized in the leg harness assemblies of FIG. 5.
Figure 5:
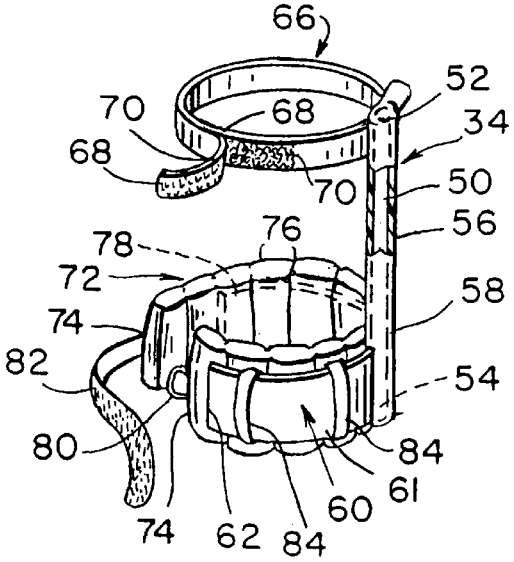
FIG. 5 is an enlarged diagrammatic perspective view, with parts broken away, of the leg harness assemblies generally enclosed in the dotted areas identified generally by arrows 5 in FIG. 3.

The specific configuration of the right leg harness assembly 34 can best be seen in FIGS. 5 and 6, which are an enlarged diagrammatic perspective view, with parts broken away, of the leg harness assemblies generally enclosed in the dotted areas identified generally by arrows 5 in FIG. 3, and an enlarged diagrammatic perspective view, with parts broken away, of a molded support member utilized in the leg harness assemblies of FIG. 5, respectively, and as such will be discussed with reference thereto.

It is to be understood, however, that the configuration and operation of the left leg harness assembly 38 is identical to that of the right leg harness assembly 34, therefore, for the sake of brevity, only the right leg harness assembly 34 will be discussed.

The right leg harness assembly 34 includes a right leg harness assembly semi-rigid, elongated, and generally rectangular-shaped side support rod 50 that is positionable along the right abductor muscle of the wearer leg abductor muscles 18 on the centerline of the outside of the right leg of the wearer legs 20 of the wearer 14.

The right leg harness assembly semi-rigid, elongated, and generally rectangular-shaped side support rod 50 of the right leg harness assembly 34 has a right leg harness assembly side support rod upper end 52 which extends vertically downwardly from the right leg harness assembly attaching sub-assembly adjustable strap 46 of the right leg harness assembly attaching sub-assembly 36, and a right leg harness assembly side support rod lower end 54 which is disposed vertically below the right leg harness assembly side support rod upper end 52 of the right leg harness assembly semi-rigid, elongated, and generally rectangular-shaped side support rod 50 of the right leg harness assembly 34.

The right leg harness assembly semi-rigid, elongated, and generally rectangular-shaped side support rod 50 of the right leg harness assembly 34 is preferably approximately 10" long, is preferably made of unbreakable plastic, and is covered preferably with right leg harness assembly side support rod thick layer of padding 56 which in turn is covered preferably with right leg harness assembly side support rod layers of vinyl or nylon 58, so that the right abductor muscle of the wearer leg abductor muscles 18 on the centerline of the outside of the right leg of the wearer legs 20 of the wearer 14 is cushioned from direct contact with the right leg harness assembly semi-rigid, elongated, and generally rectangular-shaped side support rod 50 of the right leg harness assembly 34.

The right leg harness assembly 34 further includes a right leg harness assembly semi-rigid and generally C-shaped support 60 that has a right leg harness assembly generally C-shaped support pair of legs 61, a right leg harness assembly generally C-shaped support legs pair of free ends 62, and a right leg harness assembly generally C-shaped support midpoint 64 that is disposed at the midpoint between the right leg harness assembly generally C-shaped support legs pair of free ends 62 of the right leg harness assembly generally C-shaped support pair of legs 61 of the right leg harness assembly semi-rigid and generally C-shaped support 60 of the right leg harness assembly 34.

The right leg harness assembly semi-rigid and generally C-shaped support 60 of the right leg harness assembly 34 extends perpendicularly horizontally inwardly from the right leg harness assembly semi-rigid, elongated, and generally rectangular-shaped side support rod 50 of the right leg harness assembly 34, with the right leg harness assembly generally C-shaped support midpoint 64 of the right leg harness assembly semi-rigid and generally C-shaped support 60 of the right leg harness assembly 34 being coincident with the right leg harness assembly side support rod lower end 54 of the of the right leg harness assembly semi-rigid, elongated, and generally rectangular-shaped side support rod 50 of the right leg harness assembly 34, and with the right leg harness assembly generally C-shaped support legs pair of free ends 62 of the right leg harness assembly generally C-shaped support pair of legs 61 of the right leg harness assembly semi-rigid and generally C-shaped support 60 of the right leg harness assembly 34 extending approximately 6" inwardly therefrom.

The right leg harness assembly semi-rigid and generally C-shaped support 60 of the right leg harness assembly 34 is preferably made of unbreakable plastic and is preferably integrally molded with the right leg harness assembly semi-rigid, elongated, and generally rectangular-shaped side support rod 50 of the right leg harness assembly 34, so that a continuous and strong support is provided.

The right leg harness assembly 34 further includes a right leg harness assembly open-ended and flexible upper strap 66 that extends horizontally inwardly from the right leg harness assembly side support rod upper end 52 of the right leg harness assembly semi-rigid, elongated, and generally rectangular-shaped side support rod 50 of the right leg harness assembly 34, has a pair of right leg harness assembly upper strap free ends 68, and is encirclingly positionable around the upper portion of the right thigh of the wearer thighs 22 of the right leg of the wearer legs 20 of the wearer 14, in proximity to the right hip of the wearer hips 16 of the wearer 14.

The right leg harness assembly open-ended and flexible upper strap 66 of the right leg harness assembly 34 is open ended, so that the right leg harness assembly 34 can be easily attached to the right thigh of the wearer thighs 22 of the right leg of the wearer legs 20 of the wearer 14 without the wearer 14 having to raise the right leg of the wearer legs 20 of the wearer 14, and further the right leg harness assembly 34 can be properly adjustably positioned on the right thigh of the wearer thighs 22 of the right leg of the wearer legs 20 of the wearer 14 regardless of the size of the upper portion of the right thigh of the wearer thighs 22 of the right leg of the wearer legs 20 of the wearer 14.

The right leg harness assembly open-ended and flexible upper strap 66 of the right leg harness assembly 34 is preferably made of sturdy nylon webbing, and has disposed on the pair of right leg harness assembly upper strap free ends 68 thereof, right leg harness assembly upper strap free ends complementary portions of hook and loop fasteners 70, so that the right leg harness assembly open-ended and flexible upper strap 66 of the right leg harness assembly 34 can be releasibly maintained around the upper portion of the right thigh of the wearer thighs 22 of the right leg of the wearer legs 20 of the wearer 14.

The right leg harness assembly 34 further includes a right leg harness assembly open-ended and flexible lower weighted strap 72 that extends horizontally inwardly from the right leg harness assembly side support rod lower end 54 of the right leg harness assembly semi-rigid, elongated, and generally rectangular-shaped side support rod 50 of the right leg harness assembly 34, has a pair of right leg harness assembly lower strap free ends 74, and is encirclingly positionable around the lower portion of the right thigh of the wearer thighs 22 of the right leg of the wearer legs 20 of the wearer 14, above the right knee of the wearer knees 24 of the right leg of the wearer legs 20 of the wearer 14, so that binding, pinching, and loss of range of motion is prevented.

The right leg harness assembly open-ended and flexible lower weighted strap 72 of the right leg harness assembly 34 is open ended, so that the right leg harness assembly 34 can be easily attached to the lower portion of the right thigh of the wearer thighs 22 of right leg of the wearer legs 20 of the wearer 14 without the wearer 14 having to raise the right leg of the wearer legs 20 of the wearer 14, and further the right leg harness assembly 34 can be properly adjustably positioned on the right thigh of the wearer thighs 22 of the right leg of the wearer legs 20 of the wearer 14 regardless of the size of the lower portion of the right thigh of the wearer thighs 22 of the right leg of the wearer legs 20 of the wearer 14.

The right leg harness assembly open-ended and flexible lower weighted strap 72 of the right leg harness assembly 34 is preferably made from two sheets of opposing and generally rectangular-shaped flexible material 76, preferably filled therebetween with lead shot or other similar material, and sewn along the periphery thereof and vertically in intervals therealong so as to produce right leg harness assembly lower weighted strap plurality of individual segmented pockets of weight 78, so that the weight of the right leg harness assembly lower weighted strap plurality of individual segmented pockets of weight 78 of the right leg harness assembly open-ended and flexible lower weighted strap 72 of the right leg harness assembly 34 is distributed evenly around the lower portion of the right thigh of the wearer thighs 22 of the right leg of the wearer legs 20 of the wearer 14 and thereby providing resistance for the upper portion of the right thigh of the wearer thighs 22 of the right leg of the wearer legs 20 of the wearer 14 during usage while allowing increased speed of the right leg of the wearers legs 20 of the wearer 14 as a result of the overall positioning of the exercise thigh weight system 10.

The right leg harness assembly open-ended and flexible lower weighted strap 72 of the right leg harness assembly 34 further includes a right leg harness assembly lower weighted strap tension ring 80 that is disposed on one free end of the pair of right leg harness assembly lower strap free ends 74 of the right leg harness assembly open-ended and flexible lower weighted strap 72 of the right leg harness assembly 34.

The right leg harness assembly open-ended and flexible lower weighted strap 72 of the right leg harness assembly 34 further includes a right leg harness assembly lower weighted strap hook and loop fastener coated mini-strap 82, that has complementary portions of hook and loop fasteners disposed adjacent to each other and on the outer side thereof, and extends outwardly from another free end of the pair of right leg harness assembly lower strap free ends 74 of the right leg harness assembly open-ended and flexible lower weighted strap 72 of the right leg harness assembly 34.

The right leg harness assembly lower weighted strap hook and loop fastener coated mini-strap 82 of the another free end of the pair of right leg harness assembly lower strap free ends 74 of the right leg harness assembly open-ended and flexible lower weighted strap 72 of the right leg harness assembly 34 passes freely through the right leg harness assembly lower weighted strap tension ring 80 of the one free end of the pair of right leg harness assembly lower strap free ends 74 of the right leg harness assembly open-ended and flexible lower weighted strap 72 of the right leg harness assembly 34, and doubles back on itself, with the complementary portions of the hook and loop fasteners of the right leg harness assembly lower weighted strap hook and loop fastener coated mini-strap 82 of the another free end of the pair of right leg harness assembly lower strap free ends 74 of the right leg harness assembly open-ended and flexible lower weighted strap 72 of the right leg harness assembly 34 engaging each other, so that the right leg harness assembly open-ended and flexible lower weighted strap 72 of the right leg harness assembly 34 can be releasibly maintained around the lower portion of the right thigh of the wearer thighs 22 of the right leg of the wearer legs 20 of the wearer 14.

The outermost sheet of the two sheets of opposing and generally rectangular-shaped flexible material 76 of the right leg harness assembly open-ended and flexible lower weighted strap 72 of the right leg harness assembly 34 has disposed thereon, to both sides of the right leg harness assembly semi-rigid, elongated, and generally rectangular-shaped side support rod 50 of the right leg harness assembly 34, an outermost sheet plurality of spaced-apart and vertically-oriented loops 84.

The outermost sheet plurality of spaced-apart and vertically-oriented loops 84 of the outermost sheet of the two sheets of opposing and generally rectangular-shaped flexible material 76 of the right leg harness assembly open-ended and flexible lower weighted strap 72 of the right leg harness assembly 34 releasibly and snugly receive the right leg harness assembly generally C-shaped support pair of legs 61 of the right leg harness assembly semi-rigid and generally C-shaped support 60 of the right leg harness assembly 34, with the right leg harness assembly open-ended and flexible lower weighted strap 72 of the right leg harness assembly 34 snugly abutted against the right leg harness assembly semi-rigid and generally C-shaped support 60 of the right leg harness assembly 34, and with the right leg harness assembly generally C-shaped support legs pair of free ends 62 of the right leg harness assembly generally C-shaped support pair of legs 61 of the right leg harness assembly semi-rigid and generally C-shaped support 60 of the right leg harness assembly 34 terminating slightly prior to the pair of right leg harness assembly lower strap free ends 74 of the right leg harness assembly open-ended and flexible lower weighted strap 72 of the right leg harness assembly 34, so that the right leg harness assembly open-ended and flexible lower weighted strap 72 of the right leg harness assembly 34 is kept stable and prevented from sagging on the inner portion of the right thigh of the wearer thighs 22 of the right leg of the wearer legs 20 of the wearer 14 and from slipping downwardly from the right thigh of the wearer thighs 22 of the right leg of the wearer legs 20 of the wearer 14 during prolonged exercise.

The manner of donning the exercise thigh weight system 10 will be discussed, infra:

STEP 1: The sturdy, semi-rigid, and adjustable waist belt 26 is replaceably attached around the wearer waist 12 of the wearer 14, ascertaining that the sturdy, semi-rigid, and adjustable waist belt 26 is properly in place and that the right leg harness assembly semi-rigid, elongated, the generally rectangular-shaped side support rod 50 of the right leg harness assembly 34 is aligned along the outside center of the right thigh of the wearer thighs 22 of the right leg of the wearer legs 20 of the wearer 14 and that the left leg harness assembly semi-rigid, elongated, and generally rectangular-shaped side support rod of the left leg harness assembly 38 is aligned along the outside center of the left thigh of the wearer thighs 22 of the left leg of the wear legs 20 of the wearer 14.

STEP 2: The right leg harness assembly attaching sub-assembly wide and looped weight-bearing strap 42 of the right leg harness assembly attaching sub-assembly 36 is positioned on the sturdy, semi-rigid, and adjustable waist belt 26 at the waist belt right hip point 28 of the sturdy, semi-rigid, and adjustable waist belt 26.

STEP 3: The left leg harness assembly attaching sub-assembly wide and looped weight-bearing strap of the left leg harness assembly attaching sub-assembly 40 is positioned on the sturdy, semi-rigid, and adjustable waist belt 26 at the waist belt left hip point 29 of the sturdy, semi-rigid, and adjustable waist belt 26.

STEP 4: The right leg harness assembly attaching sub-assembly adjustable strap 46 of the right leg harness assembly attaching sub-assembly 36 is adjusted, by use of the right leg harness assembly attaching sub-assembly adjusting tension clip 48 of the right leg harness assembly attaching sub-assembly 36, until the right leg harness assembly open-ended and flexible lower weighted strap 72 of the right leg harness assembly 34 is several inches above the right knee of the wearer knees 24 of the right leg of the wearer legs 20 of the wearer 14, so that binding, pinching, and loss of range of motion is prevented.

STEP 5: The left leg harness assembly attaching sub-assembly adjustable strap of the left leg harness assembly attaching sub-assembly is adjusted, by use of the left leg harness assembly attaching sub-assembly adjusting tension clip of the left leg harness assembly attaching sub-assembly, until the left leg harness assembly open-ended and flexible lower weighted strap of the left leg harness assembly 38 is several inches above the left knee of the wearer knees 24 of the left leg of the wearer legs 20 of the wearer 14, so that binding, pinching, and loss of range of motion is prevented.

STEP 6: The right leg harness assembly open-ended and flexible upper strap 66 of the right leg harness assembly 34 is wrapped snugly around the upper portion of the right thigh of the wearer thighs 22 of the right leg of the wearer legs 20 of the wearer 14, and is maintained snugly therearound by engaging the right leg harness assembly upper strap free ends complementary portions of hook and loop fasteners 70 of the pair of right leg harness assembly upper strap free ends 68 of the right leg harness assembly open-ended and flexible upper strap 66 of the right leg harness assembly 34 with each other.

STEP 7: The left leg harness assembly open-ended and flexible upper strap of the left leg harness assembly is wrapped snugly around the upper portion of the left thigh of the wearer thighs 22 of the left leg of the wearer legs 20 of the wearer 14, and is maintained snugly therearound by engaging the left leg harness assembly upper strap free ends complementary portions of hook and loop fasteners of the pair of left leg harness assembly upper strap free ends of the left leg harness assembly open-ended and flexible upper strap of the left leg harness assembly 38 with each other.

STEP 8: The right leg harness assembly open-ended and flexible lower weighted strap 72 of the right leg harness assembly 34 is wrapped snugly around the lower portion of the right thigh of the wearer thighs 22 of the right leg of the wearer legs 20 of the wearer 14, and is maintained snugly therearound by passing the right leg harness assembly lower weighted strap hook and loop fastener coated mini-strap 82 of the another free end of the pair of right leg harness assembly lower strap free ends 74 of the right leg harness assembly open-ended and flexible lower weighted strap 72 of the right leg harness assembly 34 freely through the right leg harness assembly lower weighted strap tension ring 80 of the one free end of the pair of right leg harness assembly lower strap free ends 74 of the right leg harness assembly open-ended and flexible lower weighted strap 72 of the right leg harness assembly 34 and doubling back on itself with the complementary portions of the hook and loop fasteners of the right leg harness assembly lower weighted strap hook and loop fastener coated mini-strap 82 of the another free end of the pair of right leg harness assembly lower strap free ends 74 of the right leg harness assembly open-ended and flexible lower weighted strap 72 of the right leg harness assembly 34 engaging each other.

STEP 9: The left leg harness assembly open-ended lower weighted strap of the left leg harness assembly 38 is wrapped snugly around the lower portion of the left thigh of the wearer thighs 22 of the left leg of the wearer legs 20 of the wearer 24, and is maintained snugly therearound by passing the left leg harness assembly lower weighted strap hook and loop fastener coated mini-strap of the another free end of the pair of left leg harness assembly lower strap free ends of the left leg harness assembly open-ended lower weighted strap of the left leg harness assembly 38 freely through the left leg harness assembly lower weighted strap tension ring of the one free end of the pair of left leg harness assembly lower strap free ends of the left leg harness assembly open-ended lower weighted strap of the left leg harness assembly 38 and doubling back on itself with the complementary portions of the hook and loop fasteners of the left leg harness assembly lower weighted strap hook and loop fastener coated mini-strap of the another free end of the pair of left leg harness assembly lower strap free ends of the left leg harness assembly open-ended lower weighted strap of the left leg harness assembly 38 engaging each other.

Referring to the embodiment of FIGS. 7A through 9, FIG. 7A shows an embodiment of the invention 110 in which each leg harness 138 is provided with a semi-rigid and adjustable bridging member or support rod 139, preferably formed of unbreakable plastic material, between the upper 122 and lower 132 thigh encircling belts. This member is preferably formed of two parts 139*a* and 139*b* and are adjustable fastened together by snaps 140. By realigning the mating snaps 140 on the two parts 139*a* and 139*b* the bridging member 139 can be lengthened or shortened for a user's thigh length. Thus the invention 110 is adjustable for users of different heights.

The lower thigh encircling belt 132 has weight pockets 133, for weights to be placed therein that are disposed all around its circumference to provide for evenly distributed weight around the thigh. Each pocket has preferably a Velcro secured flap 135 which can be opened to change the weight in that pocket so that the weights 136 can be adjusted for different degrees of difficulty of the exercise by the user as shown in FIG. 7C.

The waist belt 110 has a first separate portion 111 which is preferably formed of nylon webbing material and has a second separate portion 112 preferably formed of rigid material to provide a support surface for the weights as a backing which is fastened to the nylon webbing material portion 111 by either stitching, adhesively or otherwise affixed. A portion of the nylon webbing material 111 on each end 113 of the belt nearest the buckle portions extends beyond the length of the rigid backing portion 112 so that by means of looping back the end portions 113 of the webbing portion 111 so as to pull the end portion 113 back and fastened preferably by Velcro material 114 to the belt, thereby adjusting the waist of the belt 110 for the user. In this way the belt 110 can be adjusted for different users having different waist sizes.

Figure 7A:
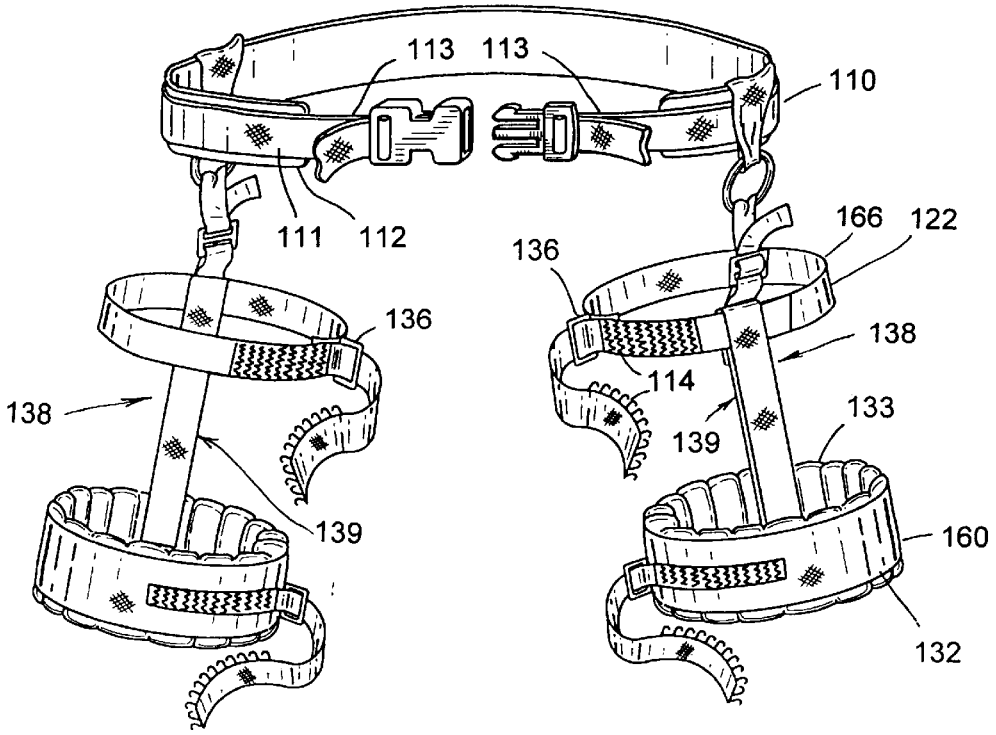
FIG. 7A is an enlarged diagrammatic perspective view of an embodiment of the present invention.
Figure 7B:
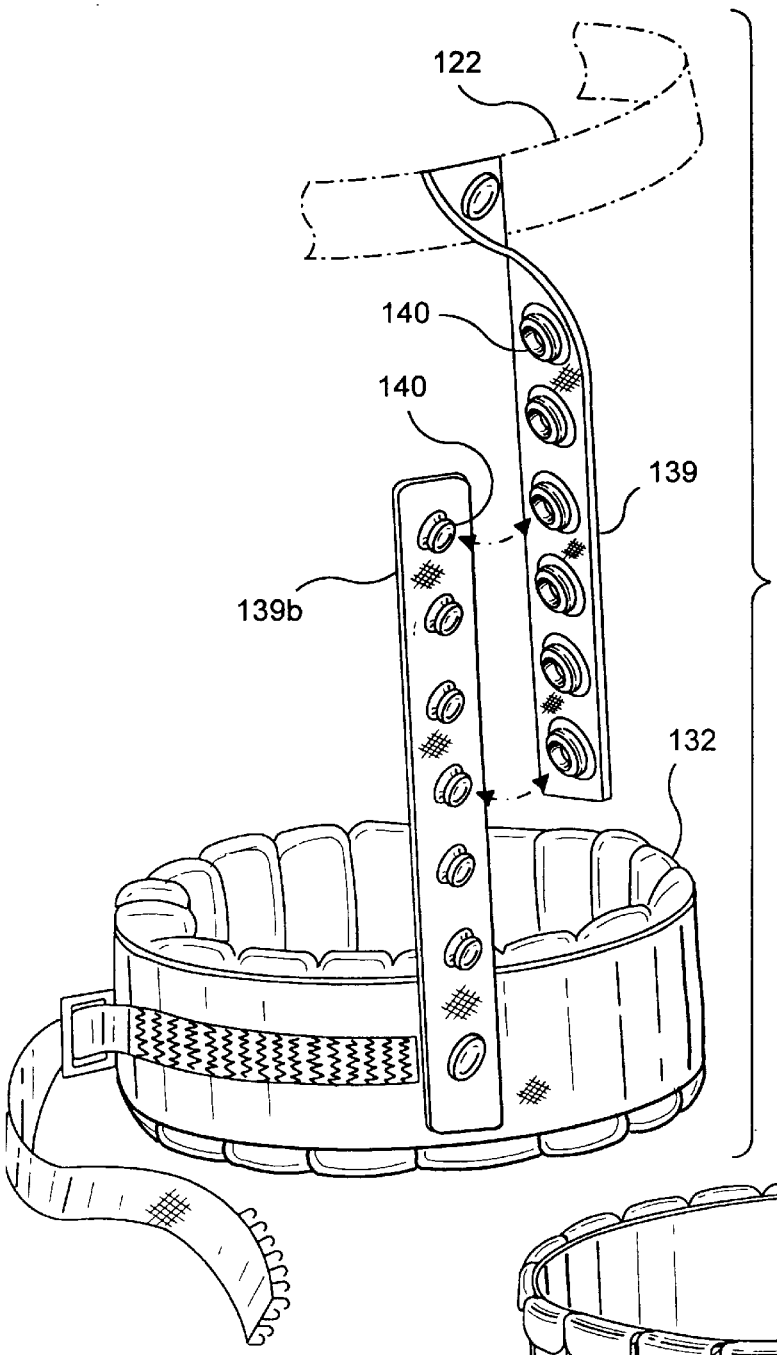
FIG. 7B is a partial exploded view of FIG. 7A of the invention illustrating the adjustable thigh length by means of snaps.
Figure 7C:
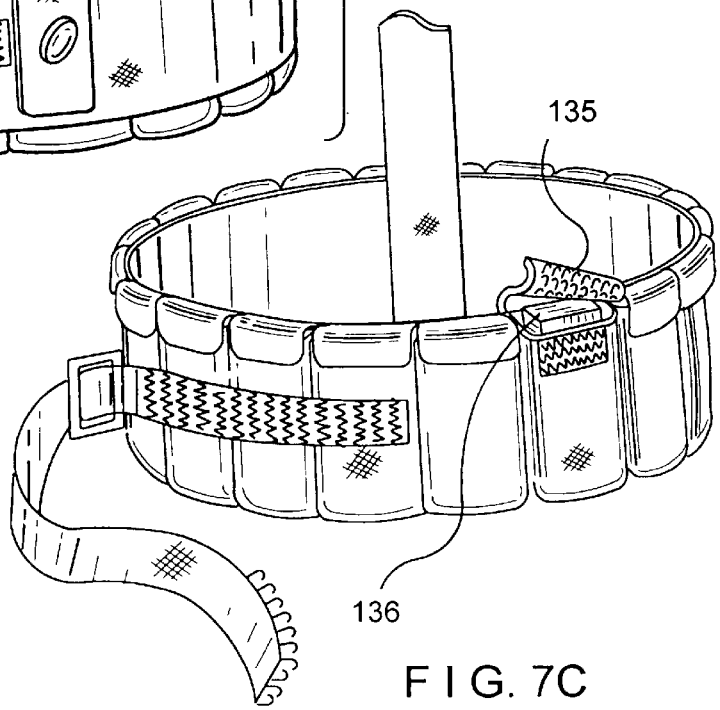
FIG. 7C is a partial view of FIG. 7A of the invention.

The upper 122 and lower 132 thigh belts have similar looping arrangements or else D rings 136 for adjusting these belts 122, 132 for the thigh thickness of the particular user as shown in FIGS. 7A, 7B and 7C. The upper and lower thigh belts 122, 132, respectively are each preferably formed of two parts; a nylon webbing portion and a semi-rigid portion connected together wherein similar or same fashion as described above for the waist belt. The upper and lower thigh belts, 122, 132, can be adjusted for a user's upper and lower thigh widths, with the end portion of the webbing portion of each upper and lower thigh belt pulled back and fastened to its respective thigh belt by Velcro fastening materials.

Figure 8:
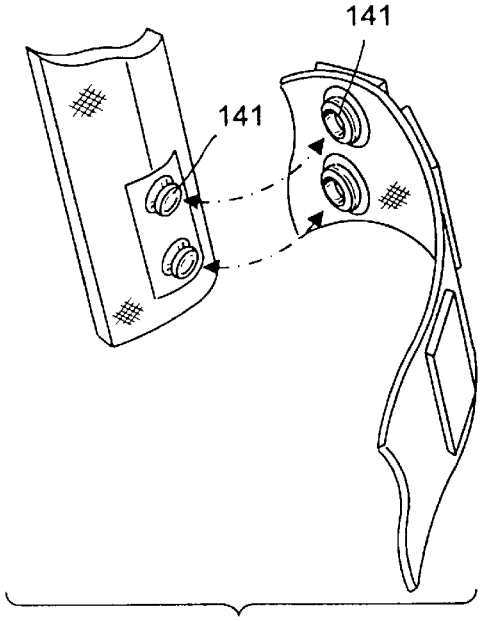
Figure 9:
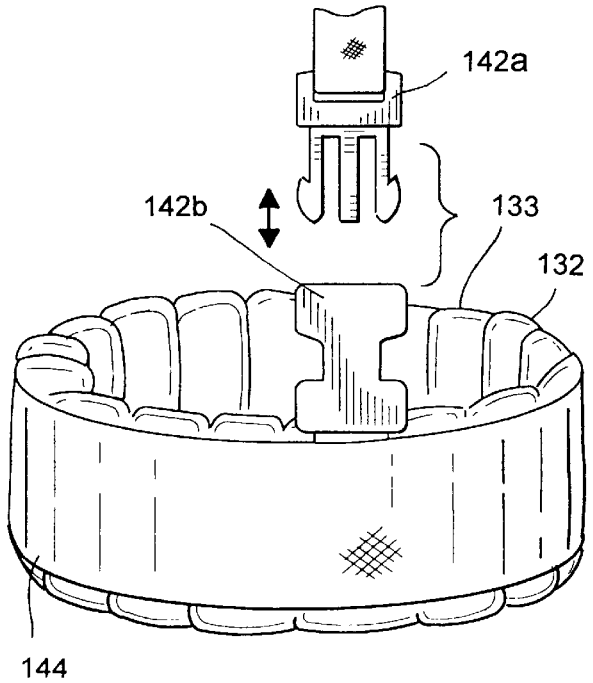
Figure 10:
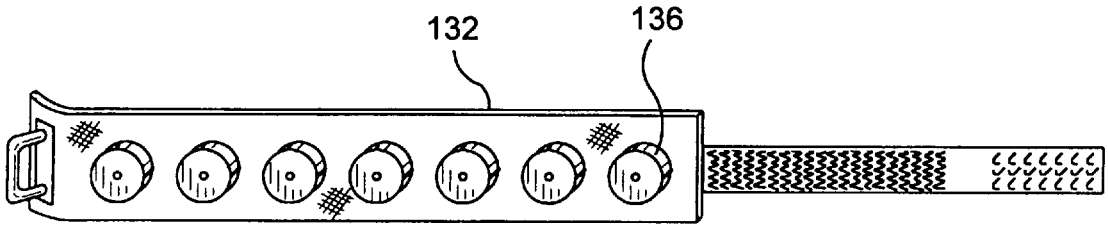
Figure 11:
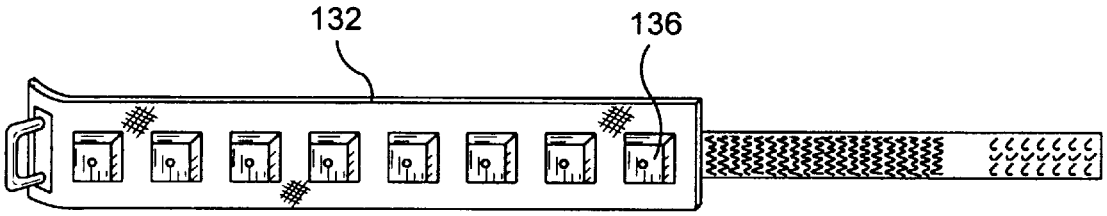
Figure 12:
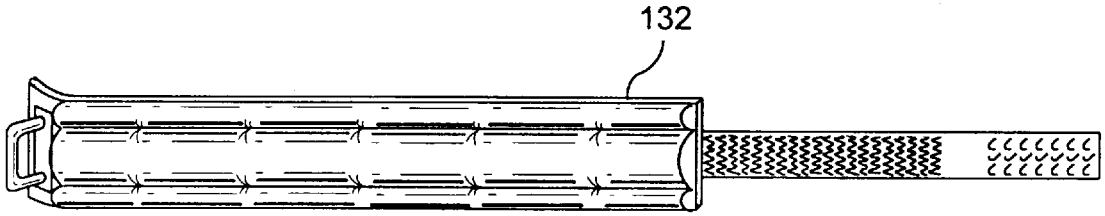
Figure 13:
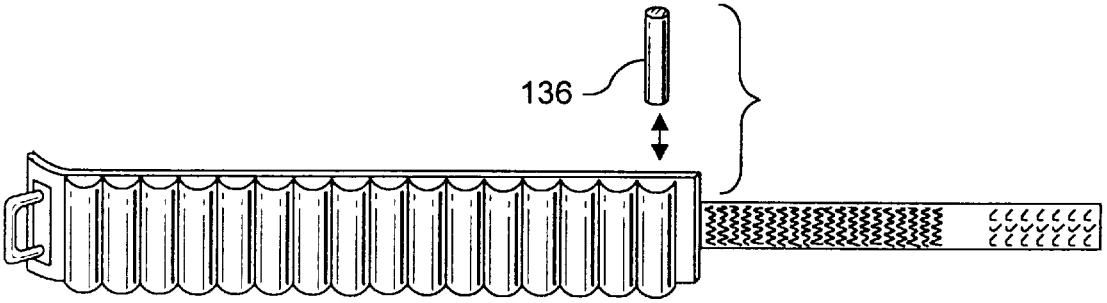

FIGS. 8–9 are alternate embodiments of how the bridging element 139 connects to the upper and lower thigh belts 122, 132, respectively either by snaps 141 (FIG. 8) to the semi-rigid portion of the thigh belt or by belt latch 142*a*, 142*b* (similar to a seat belt) as shown in FIG. 9. The semi-rigid material is to bucklepiece attached to the semi-rigid material 144 of the belt 132. It is preferably made of unbreakable plastic material 144. FIGS. 10–13 show various alternate embodiments for weights 136 on the lower thigh belt 132 of the invention. The weights 136 can be circular (FIG. 10) or square (FIG. 11.) In FIGS. 10 and 11 these weights 136 can be fastened to a rigid outer part 144 connected to a nylon webbing belt 132. FIG. 12 also shows an outer portion containing weights 136 formed of the webbing portion fastened to the inner semi-8.6 material of the lower thigh belt. FIG. 13 provides for cylindrically shaped pockets for cylindrically shaped weights.

Figure 14:
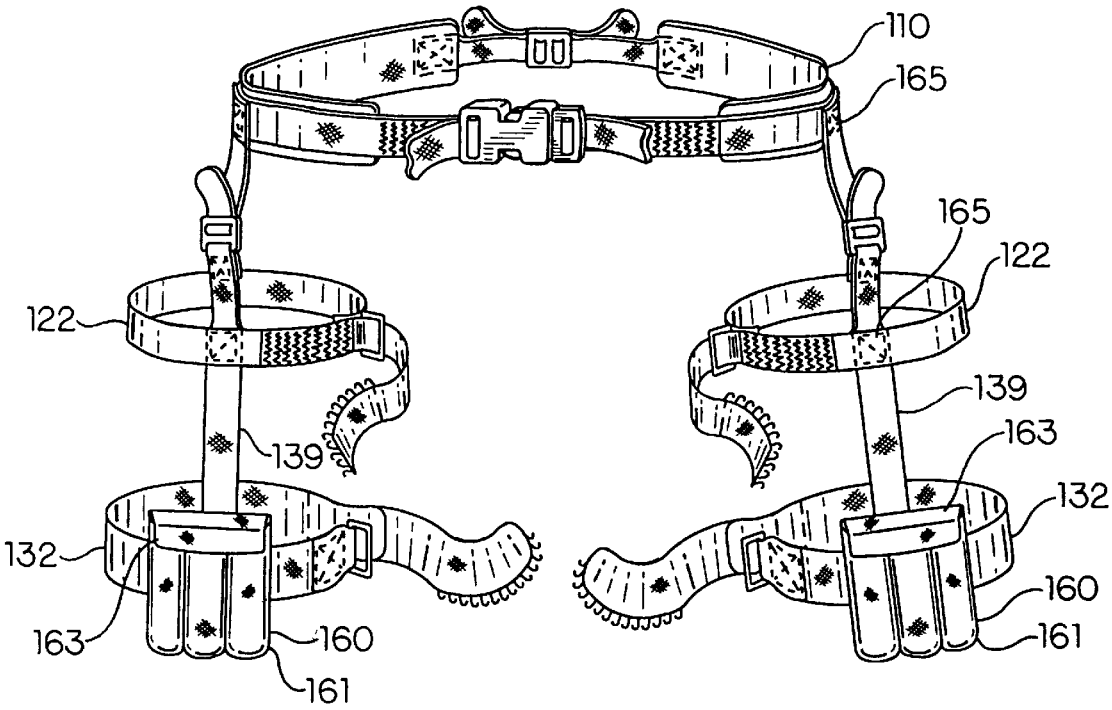
Figure 15:
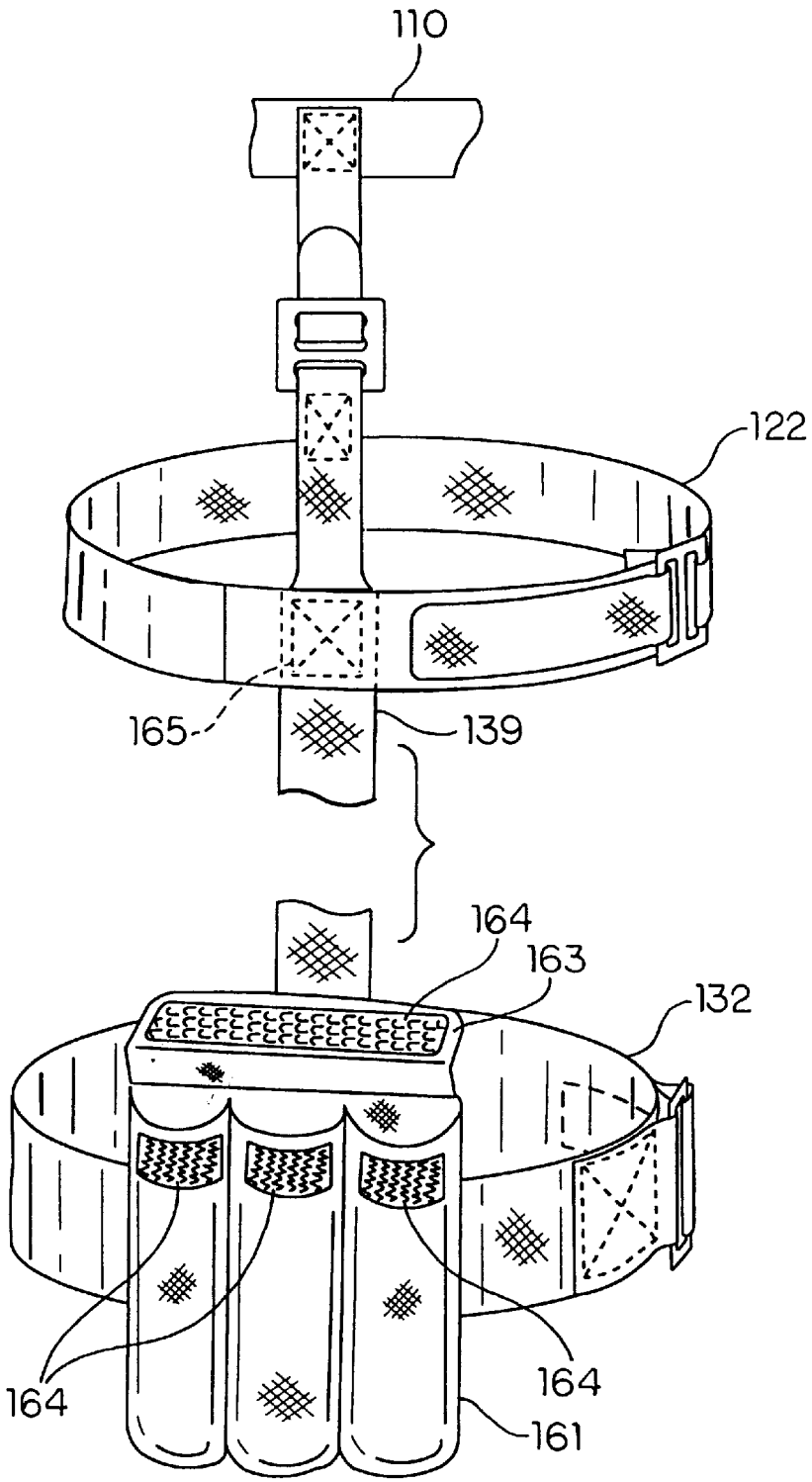

FIGS. 14 and 15 illustrate another embodiment of the present invention. The elements in this embodiment can be made as referred to above for the previous embodiment such as the waist belt, the upper and lower thigh belts and the bridging member for this embodiment. In the embodiment of the present invention of FIGS. 14 and 15 weight carrying means 160, preferably but not limited to be formed as a weight carrying pouch 161, are supported by being fixedly connected, preferably but not limited to by means of stitching 165, to the bridging member 139 and the lower thigh belt 132. The weight carrying means 161 can be made to terminate at its bottom surface flush with the bottom of the lower thigh belt 132. Each weight carrying pouch 161 is preferably disposed on portions of the lower thigh belt 132 which are located on the sides of the outer thighs of the legs of a user. By fixedly locating the weight carrying pouch 161, the weights in the weight carrying pouch 161 are stabilized and will not move or be displaced during motion and exercise. The weight carrying pouch 161 is preferably formed with a central pocket aligned along the longitudinal axis of the bridging member 139 for centralized and stabilized support and balance along the longitudinal axis of the bridging member 139. Additional weights are preferably disposed in pockets on each side of the central pocket with a preference for a three pocket pouch as shown in FIGS. 14 and 15. In this configuration the pouches are supported by the bridging member whose longitudinal axis is aligned with the longitudinal axis of the weight carrying pouch 161 and the middle pocket is aligned and supported by the bridging member 139 and balanced by the weights in the pockets in each side of the middle pocket of the weight carrying pouch 161 and worn fixedly on the outer sides of the thighs of the legs of a user so that the weights are stabilized and stay in place during motion and exercise. It is understood that the invention is not limited to this particular number of pockets. Preferably the weight carrying pouch 161 has a flap 163 which securely closes the weight carrying pouch 161 by loop and hook fastening means 164 as shown in FIG. 15.

The bridging member 139, the weight carrying pouch 161 and the lower thigh belt 132 are preferably stitched together. The bridging member 139 can be either be disposed between the weight carrying pouch 161 and the lower thigh belt 132 or the lower thigh belt 132 can be disposed between the weight carrying pouch 161 and the bridging member 139. The invention is not limited to any one such configuration. The bridging member 139, the lower thigh belt 132 and the weight carrying pouch 161 are fixedly connected by any means but preferably by stitching 165 although the invention is not limited to this means. Snaps and other fastening means can also be employed.

The bridging member 139 is also fixedly connected to the upper thigh belt 122 and to the waist belt 110 as shown in FIGS. 14–15. Again, these fixed connections is preferably by stitching 165 but other fastening means can be employed.

The bridging member 139 is preferably formed of two pieces (not shown) overlayed with respect to each other and connected to one another by hook and loop fastening means so as to be able to vary the length of the bridging member 139 particularly between the upper thigh belt 122 and the lower thigh belt 132, for the length of the legs of a user.

Alternatively the lower thigh belt 132 of FIGS. 14 and 15 can be formed by straps sewn or otherwise fixedly connected to the ends of the weight carrying means 160 or weight carrying pouch 161.

Yet another alternative is form the weight carrying means 160 or weight carrying pouch 161 as a strap forming the lower thigh belt 132.

While the invention has been illustrated and described as embodied in an exercise thigh weight system, it is not limited to the details shown, since it will be understood that various omissions, modifications, substitutions and changes in the forms and details of the device illustrated and its operation can be made by those skilled in the art without departing in any way from the spirit of the present invention.

It is to be understood that the configurations of the various components of the present invention are not merely a matter of design choice but are significant and of critical importance for, inter alia, the functions that they accomplish as discussed, supra, and any not explicitly expressed but inherent thereto. They therefore must be considered in determining patentability. Support for this assertion can be found in In re Dailey et al., 149 U.S.P.Q. 47 (CCPA 1976), where the Court held that the shape of a device must be considered in determining patentability, if the shape is significant:

> ". . . the configuration of the container is a 'mere matter of choice' not significantly novel . . . , [since] . . . Appellants have provided no argument which convinces us that the particular configuration of their container is significant . . . "[Emphasis added]

It will be understood that each of the elements described above, or two or more together, may also find a useful application in other types of constructions differing from the types described above.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An exercise thigh weight system, comprising:

a sturdy, semi-rigid and adjustable waist belt so as to adjust said waist belt to a waist of a user;

a right leg harness assembly attached to said waist belt and a left leg harness assembly attached to said waist belt, each said assembly harness including an upper thigh belt encircling entirely around a user's upper thigh and a lower thigh belt encircling around a user's lower thigh and a bridging member;

each said bridging member having a longitudinal axis and being fixedly connected to each said upper thigh belt at one end and fixedly connected to a weight carrying means at another end;

said upper thigh belt and said lower thigh belt being solely connected to each other by said bridging member;

each said weight carrying means including means for securely carrying weights along the longitudinal axis of said bridging member, said weight carrying means including means for carrying at least one weight symmetrically along said bridging member, said means for carrying at least one weight being aligned along and supported by said longitudinal axis substantially centered on said bridging member so that said at least one weight is stabilized.

2. An exercise thigh weight system according to claim 1 wherein said bridging members is formed of two pieces connected to each other by loop and fastening means so that the bridging member can be adjusted in length for the leg length of a user.

3. The exercise thigh weight system of claim 1 wherein said weight carrying means is a pouch having at least one weight pocket for carrying at least one weight therein.

4. The exercise thigh weight system of claim 3 wherein said pouch is formed with three weight carrying pockets and a middle pocket of said three pockets is disposed along said longitudinal axis of said bridging member and said remaining pockets are located on opposite sides of said middle pocket so as to provide a balanced distribution of weights on said system.

5. The exercise thigh weight system of claim 1 wherein said bridging member, said weight carrying means and said lower thigh belt are fixedly connected together by stitching.

6. The exercise thigh weight system of claim 1 wherein said bridging member and said waist belt are fixedly connected together by stitching.

7. The exercise thigh weight system of claim 1 wherein each said bridging member is disposed along an outer side of the user's thigh.

8. The exercise thigh weight system of claim 1 further comprising said lower thigh member being formed by straps connected to sides of said weight carrying means.

9. The exercise thigh weight system of claim 1 wherein said weight carrying means includes a strap forming said lower thigh belt.

10. The exercise thigh weight system of claim 1 wherein said lower thigh belt is fixedly connected to said bridging member and to said weight carrying means.

11. The exercise thigh weight system of claim 1 wherein said lower thigh belt is fixedly connected by means of stitching.

12. The exercise thigh weight system of claim 1 wherein said bridging means is formed of semi-rigid material.

13. The exercise thigh weight system of claim 3 wherein said pouch has a bottom which is flush with a bottom of said lower thigh belt.

14. The exercise thigh weight system of claim 1 wherein said weight carrying means has a longitudinal axis which is axially aligned with the longitudinal axis of the bridging member to ensure that said weights in said weight carrying means are stabilized by said bridging member.

15. The exercise thigh weight system of claim 14 wherein each said weight carrying means is located in place along an outer side of a thigh of a leg of a user.

16. The exercise thigh weight system of claim 15 wherein each said weight carrying means is supported in place by being fixedly connected to said bridging member.

17. The exercise thigh weight system of claim 1 wherein each said weight carrying means is evenly distributed either on or about the longitudinal axis of said bridging member so that said weights around said bridging member is stabilized.

18. The exercise thigh weight system of claim 1 wherein said means for carrying at least one weight includes means for carrying three weights symmetrically along said bridging member when said means for carrying at least one weight includes means for placing one weight on each side of a center weight wherein said center weight's position is centered along said longitudinal axis of said bridging member so that by positioning a weight along each side of said center weight said weights are stabilized along said bridging member.

19. The exercise thigh weight of claim 1 wherein said weight carrying member includes at least a central pocket for said at least one weight to be carried therein and said at least one central pocket is aligned and supported by the longitudinal axis of the bridging member.

20. The exercise thigh weight of claim 18 wherein said weight carrying means includes a central pocket and one pocket on each side of two sides of said central pocket so as to carry weight in each of said pockets when a weight in said central pocket and weights in said pockets on each side of said central pocket stabilize said weight along the longitudinal axis of said bridging member.

* * * * *